US008996208B2

(12) United States Patent
Shoppa et al.

(10) Patent No.: US 8,996,208 B2
(45) Date of Patent: Mar. 31, 2015

(54) SYSTEM, METHOD, AND COMPUTER-READABLE MEDIUM FOR TRACK CIRCUIT MONITORING AND ALERTING IN AUTOMATIC TRAIN CONTROL SYSTEMS

(75) Inventors: Timothy Shoppa, Bethesda, MD (US); Johann B. Glansdorp, Annandale, VA (US)

(73) Assignee: Washington Metropolitan Area Transit Authority (WMTA), Washington, DC (US)

( * ) Notice: Subject to any disclaimer, the term of this patent is extended or adjusted under 35 U.S.C. 154(b) by 143 days.

(21) Appl. No.: 13/544,402

(22) Filed: Jul. 9, 2012

(65) Prior Publication Data

US 2014/0012438 A1 Jan. 9, 2014

(51) Int. Cl.

| | |
|---|---|
| ***G05D 3/00*** | (2006.01) |
| ***B61L 3/22*** | (2006.01) |
| ***B61L 27/00*** | (2006.01) |
| ***B61L 1/18*** | (2006.01) |
| *G05D 7/00* | (2006.01) |

(52) U.S. Cl.

CPC ..... *B61L 3/221* (2013.01); *B61L 27/0088* (2013.01); *B61L 1/188* (2013.01)

USPC ..... 701/19; 701/20

(58) Field of Classification Search

CPC ..... B61L 1/18; B61L 1/188; B61L 3/221; B61L 27/0088

USPC ..... 701/19–20; 246/41, 256

See application file for complete search history.

(56) References Cited

U.S. PATENT DOCUMENTS

| | | | | |
|---|---|---|---|---|
| 3,838,270 | A * | 9/1974 | Ballinger et al. | 246/130 |
| 5,947,423 | A | 9/1999 | Clifton et al. | |
| 7,188,057 | B2 * | 3/2007 | Birkelbach et al. | 703/7 |
| 2002/0096605 | A1 | 7/2002 | Berry et al. | |
| 2012/0001029 | A1 | 1/2012 | Kondo et al. | |
| 2013/0240679 | A1 * | 9/2013 | Gruber et al. | 246/28 R |

FOREIGN PATENT DOCUMENTS

| | | |
|---|---|---|
| EP | 1 603 785 | 5/2008 |
| WO | WO-02/26543 | 4/2002 |

OTHER PUBLICATIONS

Saccomanno et al., "Risk-Based Model for Identifying Highway-Rail Grade Crossing Blackspots," Transportation Research Record: Journal of the Transportation Research Board, 2004, retrieved on Nov. 25, 2014.

International Search Report issued for PCT/US2013/049576 dated Dec. 31, 2013.

* cited by examiner

*Primary Examiner* — Helal A Algahaim

*Assistant Examiner* — Nga X Nguyen

(74) *Attorney, Agent, or Firm* — Venable LLP; Jeffri A. Kaminski; Todd Richard Farnsworth

(57) ABSTRACT

A method, system, and computer readable medium may be provided for train monitoring. Track circuit data may be received including an indication of a shunted track circuit on a train track. The received track circuit data and shunted track circuit may be analyzed. A train may be tracked on the train track based on the received track circuit data. A loss in physically expected track circuit occupancy in a path of the train may be detected. A graph may be generated showing the at least one shunted track circuit over time. The graph may indicate losses or abnormalities in physically expected track circuit occupancy in the path of the train, velocity of the train, acceleration of the train, and/or a size of the train. An alert with the severity and track circuit identifier may be generated and transmitted.

39 Claims, 19 Drawing Sheets

500

```
1 occurences of ST1AA11-A2-583 length 513ft vacating early

2010 Dec 14 06:47:40 EST vacated 0 secs after ST1AA11-A2-588 length 1125ft
occupied
                         AAAAAAAAAAAAAAAAAAAA
                         11111111111111111111
                         11112222222222333333
510 ------>              --------------------
                         AAAAAAAAAAAAAAAAAAAA
                         22222222222222222222
                         --------------------
                         55566666666666666667
                         88800112334456778890
                         13807594051835262740
                         ____________________
2010 Dec 14 06:47:10 EST ....................
2010 Dec 14 06:47:24 EST X...................
2010 Dec 14 06:47:26 EST XX..................
2010 Dec 14 06:47:32 EST XXX.................
2010 Dec 14 06:47:34 EST .XX.................
2010 Dec 14 06:47:38 EST .X..................
2010 Dec 14 06:47:40 EST ..X.................
2010 Dec 14 06:47:46 EST ..XX................
2010 Dec 14 06:47:54 EST ...XX...............
2010 Dec 14 06:48:02 EST ....X...............
2010 Dec 14 06:48:04 EST ....XX..............
                             520         530
```

FIG. 5

1100

From: Smith, John

Sent: Monday, January 24, 2011 8:35 AM

To: ROCC Asst. Superintendent; MOC Asst. Superintendent; ATC Engineering; SMNT-ATC; SAFE; other groups as reqd.

Subject: RT-LOS Alarm red J03-J2-834 960

Attachments: J03-J2-538-1308254731.pdf

Importance: High

This is an automatic early warning LOS Alarm of a potentially hazardous condition.

Attached PDF has event from Mon Jan 24 20:33:31 2011 at or near track circuit J03-J2-834.

Attached PDF contains this event and 4 recent previous events.

IMMEDIATE ACTION REQUIRED

FIG. 11

1: Diverse

2: Straight-through

SYSTEM, METHOD, AND COMPUTER-READABLE MEDIUM FOR TRACK CIRCUIT MONITORING AND ALERTING IN AUTOMATIC TRAIN CONTROL SYSTEMS

BACKGROUND

Field of Invention

Embodiments of the present invention relate generally to the monitoring of vehicles for transport along a permanent track, and more particularly to a system, method, and computer-readable medium for track circuit monitoring and alerting in automatic train control systems.

SUMMARY

Aspects of the invention involve systems, methods, and computer readable medium. In one embodiment of the invention, a method may be provided for track circuit monitoring. The method may include receiving track circuit data by a computer, where the track circuit data may include an indication of at least one shunted track circuit on at least one train track. The received track circuit data and the at least one shunted track circuit may be analyzed by the computer. The computer may track at least one train on the at least one train track based on the received track circuit data. The computer may detect a loss in physically expected track circuit occupancy in a path of the at least one train. The computer may generate a graph of the at least one shunted track circuit over time. The graph may indicate losses in physically expected track circuit occupancy in the path of the at least one train, velocity of the at least one train, acceleration of the at least one train, and/or size of the at least one train. The computer may also generate and transmit an alert with a severity and track circuit identifier.

In another embodiment of the invention, a non-transitory computer-readable medium may be provided. The medium may contain instructions, which when executed by a processor causes the processor to perform operations for a train monitoring including: receiving track circuit data, where the track circuit data includes an indication of at least one shunted track circuit on at least one train track; analyzing the received track circuit data and the at least one shunted track circuit; tracking at least one train on the train track based on the received track circuit data; detecting a loss in physically expected track circuit occupancy in a path of the train; generating a graph of the at least one shunted track circuit over time, where the graph indicates at least one of: losses in physically expected track circuit occupancy in the path of the at least one train, velocity of the at least one train, acceleration of the at least one train, or size of the at least one train; and generating an alert, where the alert comprises a severity and a track circuit identifier.

In another embodiment of the invention, a train monitoring system may be provided. The system may include track circuits that may provide track circuit data. The track circuits may be located on the train track. The system may also include an output device and one or more processors. The processors may be configured to perform the following: receive track circuit data, where the track circuit data comprises at least one indication of a shunted track circuit; analyze the received track circuit data and the at least one shunted track circuit; track a at least one train on the at least one train track based on the received track circuit data; detect a loss in physically expected track circuit occupancy in a path of the at least one train; generate a graph on the output device of the at least one shunted track circuit over time, wherein the graph indicates at least one of: losses in physically expected track circuit occupancy in the path of the at least one train, velocity of the at least one train, acceleration of the at least one train, or size of the at least one train; and generate an alert abased on a severity value.

BRIEF DESCRIPTION OF THE DRAWINGS

The foregoing and other features and advantages of the invention will be apparent from the following, more particular description of various exemplary embodiments, as illustrated in the accompanying drawings wherein like reference numbers generally indicate identical, functionally similar, and/or structurally similar elements. The first digits in the reference number indicate the drawing in which an element first appears. The following example figures are provided.

FIG. 5 depicts an illustrative example graphical presentation of the three-second fit technique;

FIG. 11 depicts a sample automatic email alert;

DESCRIPTION OF THE EMBODIMENTS

Exemplary embodiments are discussed in detail below. While specific exemplary embodiments are discussed, it should be understood that this is done for illustration purposes only. In describing and illustrating the exemplary embodiments, specific terminology is employed for the sake of clarity. However, the embodiments are not intended to be limited to the specific terminology so selected. A person skilled in the relevant art will recognize that other components and configurations may be used without parting from the spirit and scope of the embodiments. It is to be understood that each specific element includes all technical equivalents that operate in a similar manner to accomplish a similar purpose. The examples and embodiments described herein are non-limiting examples.

All publications cited herein are hereby incorporated by reference in their entirety.

As used herein, the term "a" refers to one or more. The terms "including," "for example," "such as," "e.g.," "may be" and the like, are meant to include, but not be limited to, the listed examples. The term "product" may refer to both products and services.

A transit system including a collection of multiple fixed rails or a railway, such as a rapid transit system (e.g., metropolitan railway, subway, underground, elevated railway, light rail, etc.), may be provided as tracks for multiple vehicles such as trains, cars, or trucks to travel along. To avoid injury and property damage and to maximize efficiency of resources, the location of trains within the transit system may need to be monitored.

A computer or a collection of computers and associated software, such as a train monitoring and/or control system, may monitor the movement of trains within a transit system as trains enter and exit track circuits. The performance of the train control system and the track circuits and their components may also be monitored.

Figure 1A:
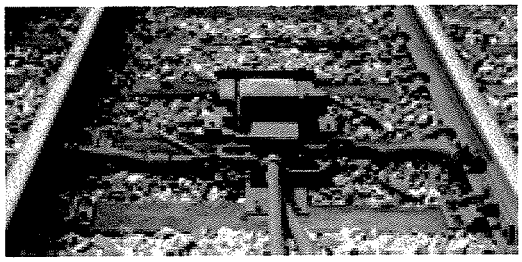
FIGS. 1A, 1B, and 1C depict an illustrative impedance bonds.
Figure 1B:
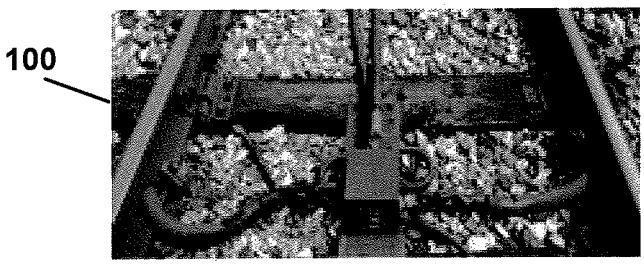

Trains may be monitored by detecting the location of a train within the railway system. Track circuits may be used to assist in detecting the location of trains. A typical Audio Frequency (AF) track circuit, also called High Frequency Track Circuit, for train detection is a section of track bounded by two tuned coupling transformers called impedance bonds. FIG. 1A depicts a GRS two-piece impedance bond. FIG. 1B depicts an impedance bond 100 Wee-Z-Bonds by GRS/Alstom. FIG. 1B depicts a US&S minibond. Additionally, other track circuits and devices may be used to monitor the tracks.

Transit system monitoring may be performed by, for example, an Automatic Train Protection (ATP) system. The ATP may be one of three subsystems of an Automatic Train Control (ATC) system. The other two subsystems may be Automatic Train Operation (ATO) and Automatic Train Supervision (ATS). ATP may be designed to provide protection against train over-speed and train collision through, for example, an automatic block signaling system (as described below). ATP may also provide control of, for example, interlocking (e.g., where trains may change tracks), route security through an interlocking section, and train door operation. ATP may also provide protection against train over-speed and train collision. ATP may include features of Automatic Block Signaling including the Audio Frequency Track Circuits and its components.

The Automatic Block Signaling System may be the wayside portion of an ATP system. The Automatic Block Signaling System may select information such as speed commands to be transmitted to a train so that, for example, civil speeds are observed and safe train separation may be maintained for the receiving train. The transmitted information may be provided based on other operating train locations, interlocking conditions, and track conditions. Equipment and circuits used in the automatic block signaling system may be, for example, ATP modules, track relays, speed command circuits, speed command control line diagrams, interfaces with interlocking, traffic circuits, and platform circuits. A block may be the length of one or more track circuits over which a train would not usually receive a speed limit change. The Automatic Block Signaling System may also detect the location of trains.

Figure 2:
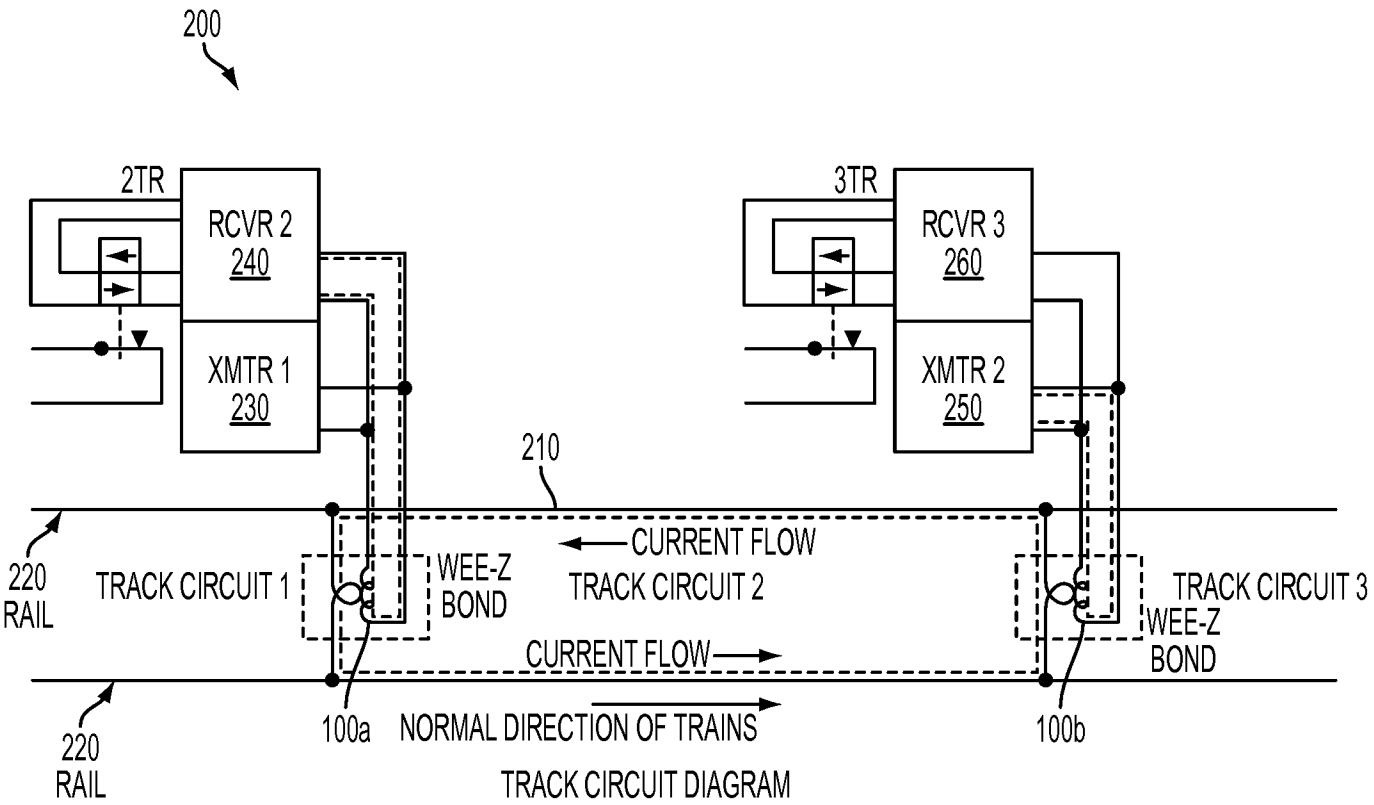
FIG. 2 depicts an illustrative un-shunted track segment.

FIG. 2 depicts illustrative un-shunted track segment 200. Un-shunted track segment 200 includes track circuit 210, rails 220, impedance bond 100*a*, impedance bond 100*b*, transmitter 230, transmitter 250, receiver 240, and receiver 260. For normal direction of train travel on a track, impedance bond 100*b* at the end where the train exits the track circuit 210 may serve as a transmitter. Impedance bond 100*b* may obtain a code rate modulated audio frequency signal from, for example, transmitter 250. Transmitter 250 may be an ATP module transmitter located in the Train Control Room (TCR), for example. Impedance bond 100*b* (i.e., the transmit bond) may couple the audio frequency signal into the running rails 220, thereby making the signal available to impedance bond 100*a* (i.e., the receive bond) at the other end of the track circuit. Once impedance bond 100*a* (i.e., the receive bond) receives the signal from the running rails 220 it may send the audio frequency signal to receiver 240. Receiver 240 may be an ATP module receiver located in the TCR. Receiver 240 may cause a track relay to be energized. This energized condition of the track relay may be referred to as "picked." A picked track circuit relay may be interpreted as an unoccupied track circuit since the signal was able to travel uninterrupted from transmitter 250 (e.g., the transmit side of the module in the train control room), to impedance bond 100*b* (e.g., the transmit bond at one end of the circuit), through the running rail 220 to impedance bond 100*a* (e.g., the receiver bond at other end of the circuit) and then to receiver 240 (e.g., back to the receiver side of the same track module in the train control room).

Figure 3:
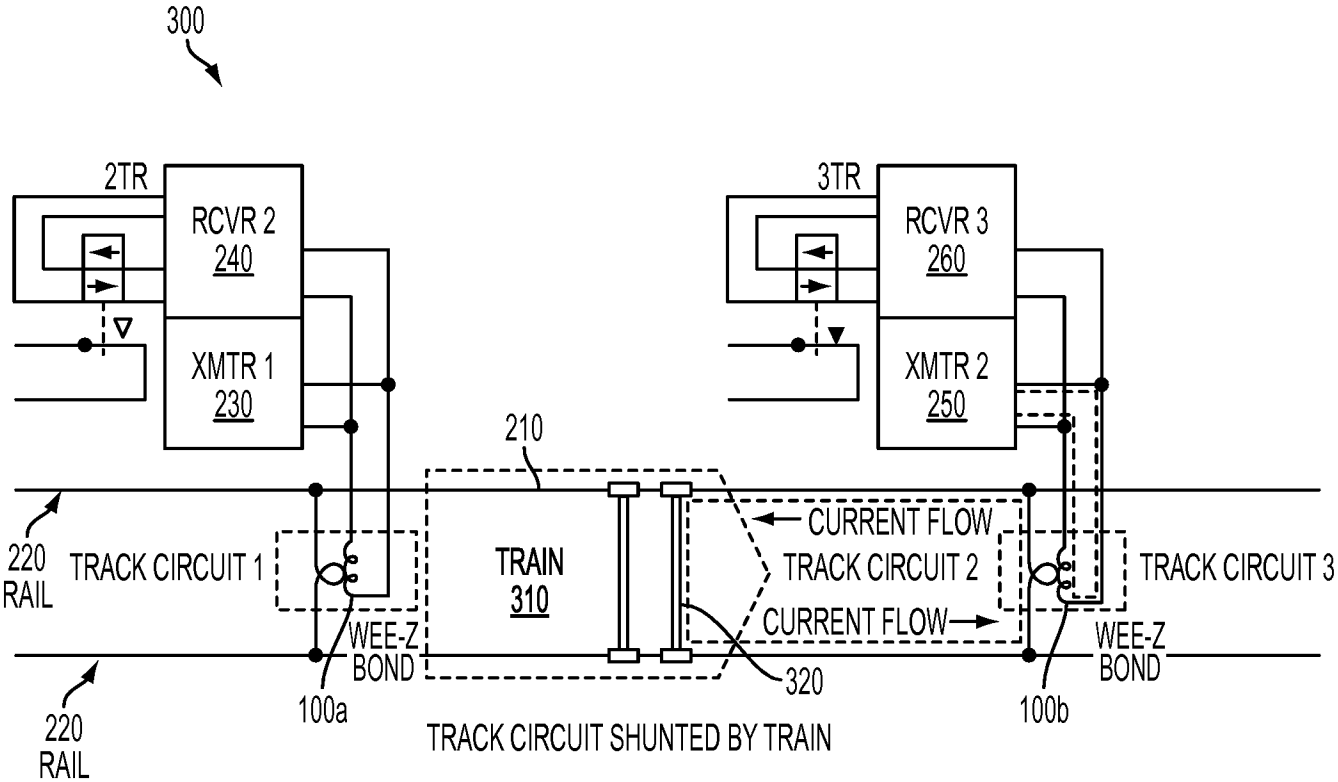
FIG. 3 depicts an illustrative shunted track segment.

FIG. 3 depicts an illustrative shunted track segment 300. Shunted track segment 300 includes track circuit 210, rails 220, impedance bond 100*a*, impedance bond 100*b*, transmitter 230, transmitter 250, receiver 240, receiver 260, train 310, and train axles 320. If train 310 is within the boundaries of track circuit 210 between impedance bond 100*a* (e.g., the receive bond) and impedance bond 100*b* (e.g., the transmit bond), as shown in FIG. 3, axles 320 will shunt the audio frequency signal away from impedance bond 100*a* (e.g., the receive bond), and insufficient signal will get to receiver 240 (e.g., the ATP module receiver). This interrupted signal may be unable to return to the receive side of the track module and may cause the track relay to be de-energized. In this shunted condition, current to coil of the relay may be interrupted and the lever arm with the contact at its end may drop away.

A dropped track relay may be interpreted as track circuit occupancy since the wheels and axles 320 of train 310 has shunted the circuit preventing sufficient current from getting to impedance bond 100*a* (e.g., the receive bond) and ultimately back to receiver 240 (e.g., the ATP module receiver in the TCR). A broken wire or a damaged component in the circuit may also interrupt the signal back to the receiver 240. This may result in the relay dropping thus providing fail safe protection required on track circuits. Each impedance bond 100 placed at the interface of two track circuits may be tuned to serve as a transmitter to the track circuit on one side and as a receiver to the adjacent track circuit on its opposite side. This arrangement may be repeated throughout the system for all mainline tracks and may establish a series of track circuits each with its corresponding ATP track module.

In interlockings (where trains can change tracks), other and/or additional forms of track circuits may be used.

A computer or computers such as the Advanced Information Management (AIM) computers may gather train and track data such as track circuit data. Data from AIM or other computers acquiring track data may be sent to other computers which may be used to identify track circuits that are not performing as expected. For example, the data may identify track circuits indicating a vacancy too early. In other words, that a train left a track circuit before a specified time interval, such as, for example, three seconds. When a too early vacant event occurred, the track circuit 210 was considered to have lost the shunting provided by the wheels and the axles 320 prematurely, that is, before the train could have physically exited track circuit 210. This event may be considered a loss of shunt (LOS).

In addition to LOS, the data may also be used to detect circuits that are out of tolerance, with loose or broken terminations, or otherwise in need of adjustment and/or repair. Accordingly, the data may be used to monitor the performance of track circuits and assess the track circuits' ability to provide reliable automatic train protection. For example, based on the data received, an alarm may be sent to key staff once a track circuit is detected to be out of tolerance as measured and compared with key indicators.

Track circuits may also be used to transmit speed limit commands to the trains. For example, When train 310 enters track circuit 210 and the track relay drops, transmitter 250 (e.g., the ATP module transmitter in the Train Control Room) may send out a speed command signal along with the train detection signal to the impedance bond 100*b* (e.g., the transmit bond) coupled to rails 220. This composite signal from impedance band 100*b* may travel through rails 220, then through the axles 320 of train 310. Receiver coils may be mounted on the cab end of each car ahead of the first axle, and the coils of the first car may inductively pick up the speed command signal. Systems in the train electronics may process this signal and provide the necessary speed for train 310.

Figure 4:
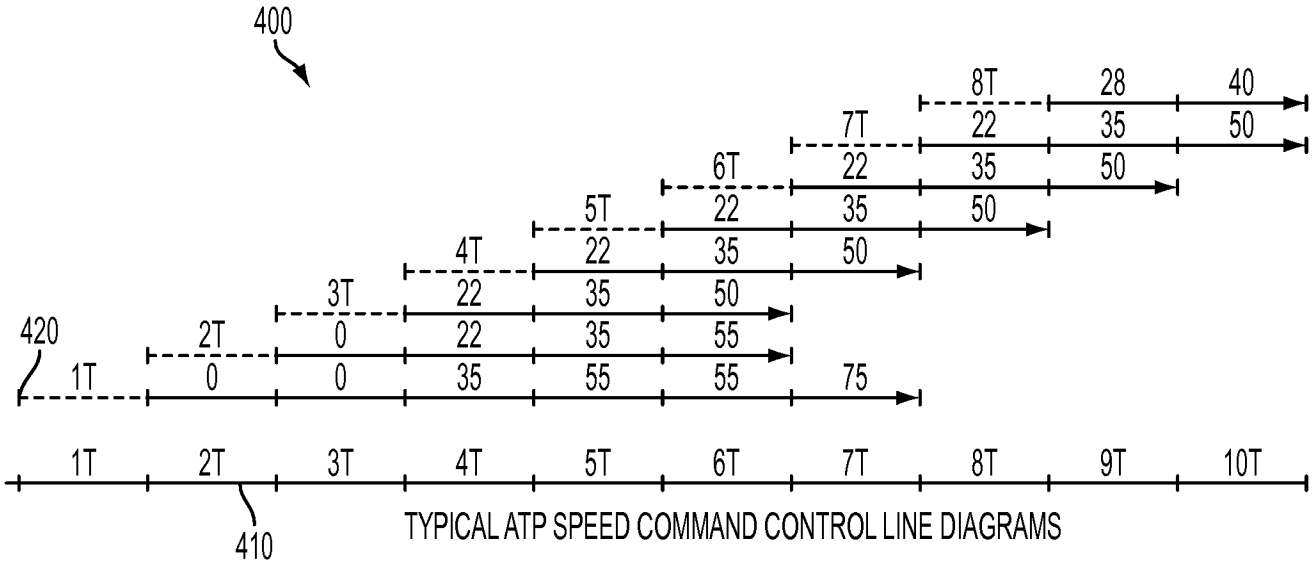
FIG. 4 depicts an illustrative automatic train protection speed command line control diagram.

FIG. 4 depicts illustrative automatic train protection speed command line control diagram 400. Train separation may be maintained by transmitting speed limit commands to train 310 as specified by ATP speed command line control diagram 400. Control Line diagrams may be developed based on the civil characteristics of the segment of track, rail car specifications, and other physical features that are needed to allow a train to brake safely in order to maintain safe train separation. The speed limit command selected by relay logics in the TCR may depend upon, for example, existing track, traffic, and/or interlocking conditions. Each speed specified on the control line diagram may have been determined by a safe braking distance. The safe breaking distance is the distance allowed as a cushion, such that a train anywhere within the block receiving the specified speed could stop within the length of unoccupied track ahead upon receiving a zero speed command. The control line diagram for a given circuit is implemented in the speed command relay logic circuitry for that circuit in the TCR. A train occupying a block may receive a speed corresponding to the length of unoccupied track ahead.

The speed command may be zero mph if, for example, track occupancy ahead is too close. Alternatively, the speed command may correspond to a maximum authorized speed allowed, for example, by the physical layout of the tracks, the number of vacant circuits ahead, traffic, and/or interlocking conditions. In the Metro system, for example, if a train is in the adjacent track circuit then the following train will receive a zero mph speed command.

In ATP speed command line control diagram 400, line 410 at the bottom indicates the track circuits (1T through 10T) for which the control lines are applicable. Line 420, the first line from the bottom, indicates that the train is in 1T track circuit, represented by the dashed section of the line, and no occupancy ahead through 7T track circuit. This train may receive a speed command of 75 MPH, as represented by the 75 in the segment 7T of the line. This speed is appropriate because up to track circuit 7T is unoccupied. If 7T is occupied, then the train in 1T may receive 55 MPH, which is represented by the value immediately before the occupied block. If 5T is occupied, then the train in 1T may receive 35 MPH. If 4T is occupied, the train in 1T may receive 0 MPH. Each line above line 420 represents the train progressively moving from one track circuit to the next, represented by the dashed section.

Track circuits may be monitored, for example, by performing a sweep of all the track circuits in the system for occupancy. The resulting data may be processed and may produce a result that indicates whether a given circuit was occupied for less than a specified time (e.g., three seconds). This may allow for the detection of trains based on their length and speed of travel. For example, a four car train may have an approximate length of 300 feet. Therefore, a four car train traveling at an approximate speed of 68 mph would take approximately 3.0 seconds for the entire length of the train to pass any given point in a circuit. Therefore, the track relays should stay dropped for at least a minimum of 3 seconds in the normal movement of trains. An engineer reviewing the graphed data produced by the tool may check if a track circuit was vacated, that is, whether the relay was "picked" in less than three seconds after the previous circuit became occupied. If a relay was "picked" in less than three seconds after the previous circuit became occupied, it may be an indication of a track circuit malfunction or it being out of adjustment because it allowed the relay to close or "pick" before the train had physically exited the boundary of the circuit. This, is called the three-second fit technique.

FIG. 5 depicts an illustrative example graph 500 of sample of data acquired under the three-second fit technique. Example graph 500 depicts the vertical axis as time in seconds and the horizontal axis in track circuits. An occupied circuit may be represented by an "X" 520 and a vacant circuit by a dot 530. Example graph 500 indicates a problem was identified with track A11-A2-588 and indicates the track length of track A11-A2-588 as 1125 feet.

An alternative to the three-second fit technique may be the strict-fit technique for detecting anomalies in track circuit performance. The strict-fit technique may attempt to place a train within the detected occupied track circuits. Strict-fit techniques may provide the following:

1. Consistent time increments. The three-second-fit technique, as in example graph 500, may provide inconsistent time increments. For example, in example graph 500, the second line is 14 seconds after the first line, while the third line is 2 seconds after the second line.
2. Improved visual interpretation of the data as the "X" and "dots" (shown in example graph 500) may be difficult to read.
3. Physical laws may be incorporated into the visual interpretation of the data. For example, example graph 500 indicated bobbing track circuits (e.g., When a track circuit drops and picks for various reasons other than the circuit actually being shunted by a train). False indications may add a level of confusion and only very experienced engineers may be able to separate the results of bobbing circuits from the valuable data. However, bobbing circuits may be easily detected by the system since this type of train movement violates the physical or normal rules of traffic flow such as progression, acceleration and breaking.
4. An indication of track circuit lengths may be provided. Example graph 500 listed the track circuit numbers but not their length. In example 500, only the length of the circuit identified as a concern is given. As a result an engineer may not readily assess the extent of the impact of the presented events.
5. An indication of track circuit lengths and time distance relationship may be provided to indicate the speed of the train.

6. Color may be used to assist in following the physically expected track circuit occupancy across a visual depiction.

Figure 6:
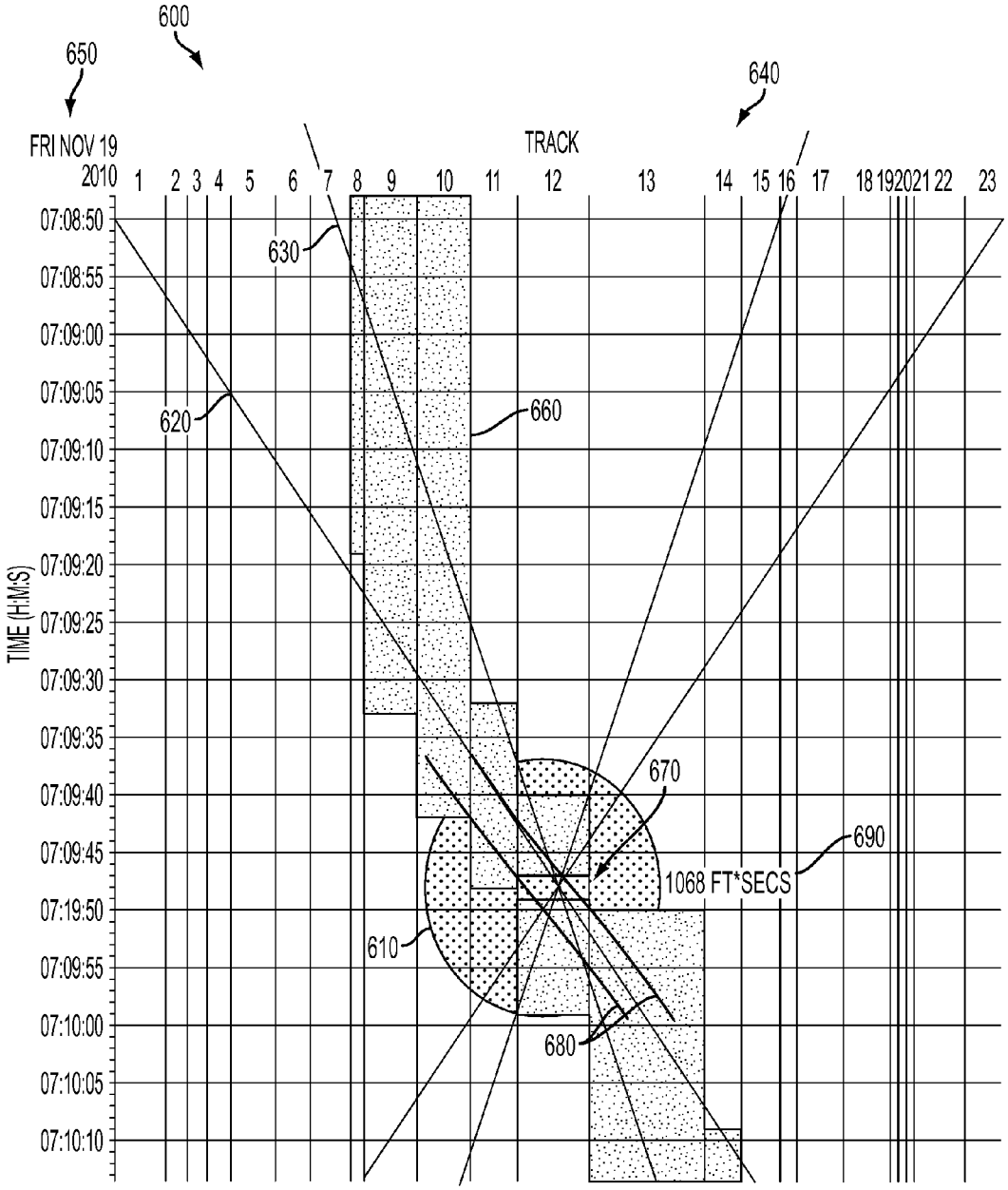
FIG. 6 depicts an illustrative example strict-fit technique graphical presentation.

FIG. 6 depicts an illustrative example strict-fit technique graphical presentation 600. Strict-fit technique graphical presentation 600 depicts a problem identified with track circuit A04-A1-108. A representative length of each track circuit and a time scale may be represented on strict-fit technique graphical presentation 600. Dots such as dot 610, may have various colors, such as red, and may be placed on strict-fit technique graphical presentation 600 plot to highlight an area where a fit problem occurs. This may assist the eye in focusing on the area of interest. Also, oblique lines 620 and 630 may be added to represent set speeds of 60 and 30 mph, respectively. These lines may allow the reviewer to assess the approximate speed at which a train was traveling. Such improvements in the output may result in greater ease in interpreting the data over the three-second technique and example graph 500. Train speeds may also be monitored through the use of the graph. Additionally, the graph may indicate a train identifier, such as a train number that allows the trains to be identified in the graph.

The strict-fit technique may use data gathered from the track circuits through, for example, remote terminal units (RTUs) and the AIM computers. This may be the same data that is viewed and used by the operations control center operators to manage the railroad each day. This may ensure that the data used by engineering, maintenance and other support staff is the same data that is viewed by the operations staff. The strict-fit technique may analyze this gathered data for losses in physically expected track circuit occupancy in the path of a train, for example.

Whenever there is track circuit occupancy at a platform with valid train to wayside communication (TWC) train length, a valid train may be created in the monitoring system. Note, some work units may not have TWC and train length, and therefore may not be tracked by the strict-fit technique. Some work units may not have consistent shunting characteristics and work unit movement may be protected by other techniques.

Under the strict-fit technique, the train may be assumed to move subject to the laws of physics and conform to the civil and engineering parameters set for the system. Parameters such as the maximum velocity of 120 feet per second (81.8 MPH) and max acceleration of 5 fps per second (3.4 MPH per second) are set in accordance with the design of the system and the established operating rules. Track malfunctions are monitored by, for example, the strict-fit technique and if the track malfunctions cause a loss of shunt, an alarm or alert may be sent out. However, by incorporating the laws of physics and engineering parameters when analyzing the track data, some track malfunctions may be discounted when locating a train on the tracks. Track malfunctions may include, for example, a broken wire, bobbing, parasitic oscillation, corrugated rail, circuits out of adjustment, damaged impedance bonds, loose connectors, broken J-bar, broken rail clamp, broken rail connector, failed automatic train protection (ATP) module transmit printed circuit board (PCB), non-vital processor failure, rusty rail surface, contaminated rail surface, defective cable, remote terminal unit defective input PCB, arcing, spurious signals capable of exploiting unintended signal paths, interference, communication problems, bad RTU status indication, an insulating axle, or network problems.

As an example, if the indications from a "bobbing" circuit were correct, it may require that a train leaps forward or extends backward instantly to occupy the circuit that is "bobbing" which may be physically impossible. Bobbing occurs when a track circuit shows an occupancy which is inconsistent with track conditions and the civil and physical characteristics of the system. Bobbing may produce false restrictions on train movement and/or disrupt the Passenger Information Display System (PIDS), for example. Also, the occupancy data for a bobbing circuit may not be sequential with the other circuits that were actually occupied. Such erroneous data may indicate that the train is occupying a circuit without ever entering the previous circuit. Such movements may not be physically possible or will violate the operating rules and engineering parameters. As a result, track circuits that are "bobbing" ahead or behind a valid train may be identified and segregated.

Figure 7:
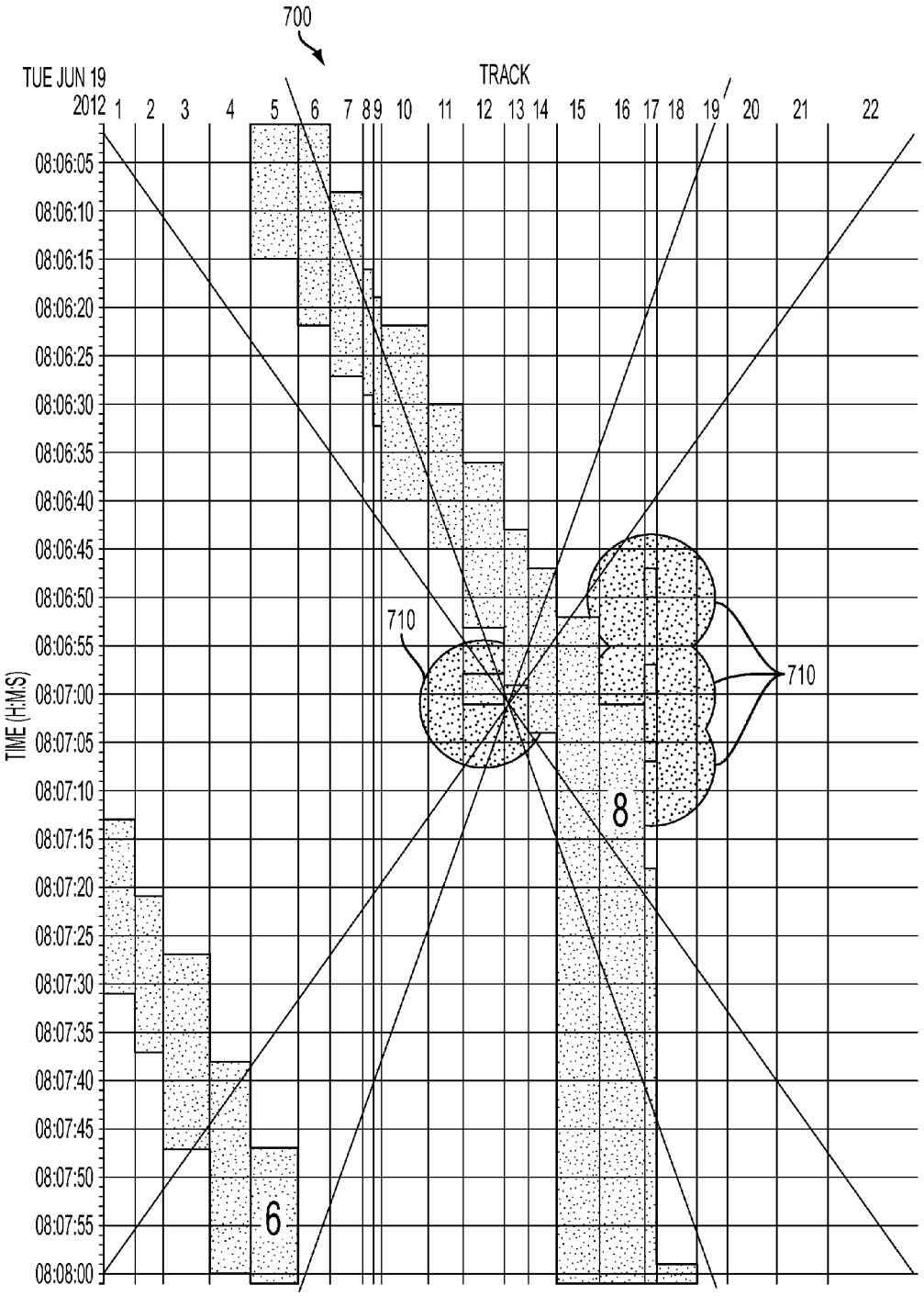
FIG. 7 depicts an illustrative visual representation of a bobbing circuit.

FIG. 7 illustrates a graphical representation 700 of an example bobbing track circuit. Graphical representation 700 depicts an example track that indicate bobbing track circuits 710.

Corrugated rail is a rail defect characterized by a repeated wavelike wear pattern on the railhead that may extend over several hundred feet or more of running rail. Corrugated rail may cause LOS events which may be detected by a LOS computer, for example. Trains moving at high speed over sections of corrugated rail may produce wheel sparks (or arcing) that sporadically and very briefly stimulates a track circuit's receiver. The effects of corrugated rail may be mitigated by requiring medium speed restrictions, which slow trains and mask the effects of corrugated rail. Corrugated rail may be corrected through rail grinding.

In a graphical representation of the strict-fit technique, a train of known length may move through the system occupying the track circuits in a sequential manner. In strict-fit technique graphical presentation 600, track circuits are represented on the horizontal axis 640 with the length of the circuit represented in a scaled manner at the top of the page. Therefore, the distance between the vertical lines on the page is the scaled length of each track circuit, measured along the horizontal axis 640. The vertical axis 650 represents the time in seconds, represented in one second intervals. As a train travels through the system, the train may be represented as occupying circuits in a left to right manner or right to left manner depending on the track and direction of train. The occupied track circuits 660 may be shaded, such as pale green, for the duration of time that they are occupied. Any gaps that may occur in the occupancy display may be called vacancies, and may remain un-shaded. A vacancy may represent a time interval that communication was interrupted, the shunt was lost, or the track circuit mechanism malfunctioned in some way. The vacancy may be graphically indicated as gap 670 between shaded areas and may be highlighted through the use of dot 610, for example.

Trains in the system may be represented by specific length with some allowance for the physical characteristics of the car and the actual performance characteristics of the system. Train length may be considered to be, for example, the length of each car (e.g., 75 feet) times the number of cars received from the TWC indication at the nearest platform. The total length of a train may be adjusted by, for example, the distance from the front of the car body to the contact point of the first pair of wheels to the rail (e.g., 8 feet) and a similar distance for the rear of the train to the contact point of the rear wheels of the last truck (were cars are attached to trucks that house the train wheels). An additional adjustment may be made for minor errors in track circuit lengths and the polling cycle of the remote terminal unit (RTU) (e.g., 50 feet). Further, an extra buffer (e.g., 50 feet) of tolerance may be applied at the boundaries of adjacent RTU domains and where adjacent track circuits are separated by insulated joints (IJs). The value of this buffer allowance (e.g., 50 feet) may be determined empirically to allow for a smooth handshake of a moving train from one RTU domain to the domain of another RTU. This may result in an overall total adjustment of length (e.g., 116 feet for some track circuits) to the computed length of any train. If no allowance were made, false indications may occur at boundaries created by insulated joints. On the other hand, too large an allowance may result in an undesirable loss of sensitivity because shorter circuits, such as those at the interlocking, may not be effectively monitored. The RTU/IJ adjustment the length of the train may be conservative and may add to the effectiveness of monitoring. Table 1 summarizes example adjustments made to the train length as discussed above.

TABLE 1

Example Train Length Adjustments

| Item | Description | Feet |
|---|---|---|
| 1 | Length of each car 75 feet. Number of cars per train "N". Length of train is N * 75 feet. For 8 car train | 600 |
| 2 | Distance from front of car to front axle 8 feet, similar for rear car. Total overhang adjustment per train | 16 |
| 3 | Adjustment for Remote terminal units (RTU) and minor errors in track circuit length including an empirical adjustment for change in domain between RTUs to allow smooth handshake | 50 |

Using the strict-fit technique, a train may be moved through occupied circuits in a manner to avoid vacancies. Unlike the strict-fit technique, the three-second fit technique may follow the path of occupancies and, therefore, may be affected by "bobbing" tracks because the system assumed that the train leaped forward or suddenly lurched backward by the distance to the "bobbing" track circuit. Since this sort of motion may not be physically possible, it may be discounted under the strict-fit technique. While avoiding the vacancies, the adjusted length of the train may be within the boundaries of the occupied track circuits. When this is impossible without crossing a vacancy the circuit that is generating the vacancy may be identified in the software and a report may be generated to tag the circuit as malfunctioning. When the train movement does not enter a vacant circuit the train may be recognized as moving as desired through the system and no report is generated. In strict-fit technique graphical presentation 600, the area within the track circuits that is occupied by a train may be indicated by, for example train indication 680. Train indication 680, may be, for example, two blue lines within the shaded green area (i.e., occupied track circuits 660). The horizontal spacing of train indication 680 may represent the adjusted length of a train as discussed above. Train indication 680 may be in a time space diagram and therefore the slope of these train motion lines may represent velocity and the curvature may represent the acceleration of the train movement.

Figure 8:
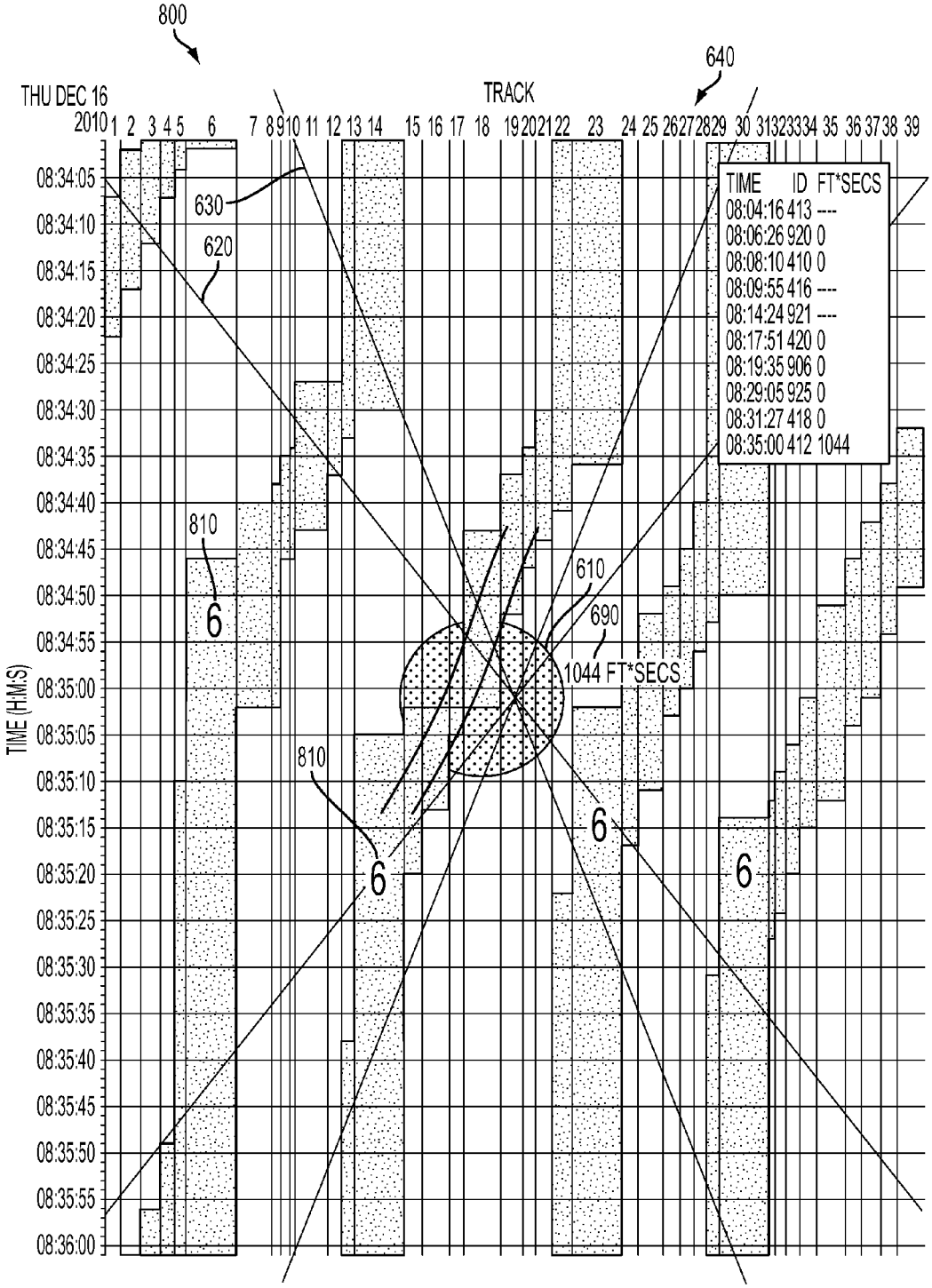
FIG. 8 depicts an illustrative graphical example of the strict-fit technique with five trains.

FIG. 8 depicts an illustrative graphical example of the strict-fit technique with five trains. Track circuit identification 640 across the top of five-train strict-fit technique graphical presentation 800 may be those used on scan sheet, code charts, or ATC track control line diagrams. Interlocking blocks may be numbered as if they are regular blocks rather than with switch identification numbers. In five-train strict-fit technique graphical presentation 800, TWC train length 810 may be represented by numbers printed into the train movement plot and may be placed on the plot at each platform. Diagonal lines 620 and 630 may help a viewer gauge velocities of +/−44 and +/−88 feet per second (e.g., 30 and 60 MPH).

A coordinate system may be used to break the railroad into its longest continuous segments and may also represent as best as possible the line colors that are used. For example, the Washington Metropolitan Area Transit Authority (WMATA) may use the following:

Red Line: Shady Grove (A15) to Glenmont (B11).

Orange Line: Vienna (K08) to New Carrollton (D13).

Green Line: Greenbelt (F11) to Branch Avenue (E10).

And some shorter segments:

Yellow Line: Huntington (C15) to the Blue line to Yellow line split at C97.

Blue Line: Franconia-Springfield (J03) to the Blue line to Yellow line split at C97.

Blue Line: The D and G line junction at D98 to Largo Town Center (G05).

Blue Line: Pentagon (C07) to Roslyn (C05).

Yellow Line: Pentagon (C07) to Yellow line to Green Line split at F03.

Under the strict-fit technique, a loss of shunt may alert personnel when the track circuit under a train indicates vacancy. Some malfunctions, such as bobbing track circuits, may be detected but may not be indicated as a loss of shunt. Bobbing track circuits may be segregated to be addressed separately to ensure that these do not cause a flood of alarms for events.

Under the three-second technique, calculations may be made based on the duration of track circuit occupancy. On the other hand, the strict-fit technique may use actual train lengths, actual track circuit lengths, the physical limits on the train velocity and acceleration matching the performance characteristics of the vehicle, and may comply with the laws of physics in mapping train movement.

Furthermore, the strict-fit technique provides an easy to follow and analyze graphical display with both time and track circuit length plotted to scale. Reviewers of the strict-fit technique may be able to assess train speed from the slope of the plotted line and may be able to determine if it was accelerating by the curvature of the plot.

Bobbing track circuits may be segregated and gathered in a report, for example. This information may be pushed out to personnel via email, SMS, instant message, a blog, Twitter, Facebook, or other social media. For example, reports may be published each morning, by email for a selected hour during the rush-hour period to the ATC engineers and WMATA safety. The report may identify any track circuit that bobbed more than a specified number of times (e.g., two times) an hour in that period. The malfunctioning circuit may be identified by line segment (e.g., D10) and the track and circuit number (e.g., D1-362) and the final entry on each line may be the number of times the circuit malfunctioned in, for example, one hour during the selected period. The report produced may identify the day and hour selected, the line, the circuit number and the number of times it bobbed in that hour. For example, "Thursday, Mar. 24, 2011, 07:22:07 to Thursday, Mar. 24, 2011, 08:22:07: D10-D1-362 4 bobs." This information may provide a representation of the performance of the system and may allow engineering personnel to work with maintenance staff to examine and correct any problems that could be the cause of the bobbing. More complete reports may be generated over time to help review bobbing throughout the system and to assess performance of the system.

When parameters of the Strict-Fit technique are violated, an event may be declared and a scoring algorithm may be called. This scoring algorithm may examine the track occupancy history around an event location. For example, the history may include plus and minus 12 seconds and plus and minus 1440 feet around the event location. This may create an area of interest that captures the circuit activities prior to and after the event. Using this data, the scoring algorithm may then attempt to fit a train through the occupancy data.

The scoring algorithm may be different from the algorithm that examines the data to identify events. The algorithm that finds events may be very strict, and the instant a train length and the travel dynamic no longer fits in the track occupancies it may record an event and may pass the data and responsibility to the scoring algorithm. The strict-fit technique may not fit the train in the occupancy data. However, the scoring algorithm is not a strict fit. The scoring algorithm uses the available, but potentially flawed, occupancy data and attempts to fit the train into the track allowing for false vacancies and potentially false occupancies.

The scoring algorithm uses the following:

1. Data with Occupancy Gaps: First the scoring algorithm examines the data for occupancy gaps of under six seconds in the track circuits. If there are any it fills in the occupancy gap and attempts to fit the train length into the occupied circuits. Many cases of corrugated rail are handled by this, for example.
2. Data with no Occupancy Gaps: If there are no occupancy gaps then the algorithm may use the laws of physics and adjacent valid occupancy/vacancy data to construct the continuous action motion of the train throughout the loss of shunt area. The loss of train detection may be identified to be under the head, tail, or all of the train depending on the modeled train motion patch.

The scoring algorithm may take the projected train motion within a specified time of the event (e.g., 24 seconds, that is, 12 seconds before and 12 seconds after the event) and may apply the data with and without gaps. The scoring algorithm may then measure how many feet of the train were not detected by the track circuit. Then, this length may be multiplied by the number of seconds that the vacancy occurred. This product, may be measured in physical units of feet*seconds. The value obtained may be used to represent the "badness" or severity of the event. Therefore, for example, if a 6 car train, which has an adjusted length of 384 feet, is completely undetected for one second, it may receive a badness of 384 ft*seconds or if an 8 car train, which has an adjusted length of 534 feet, is completely undetected for 3 seconds, it may receive a badness of 1602 ft*seconds (534 multiplied by 3). Once the badness value exceeds a specified value (e.g., 800 ft*seconds) an alert may be generated. For example, an e-Mail to alert ATC Engineering staff of an event may read: "ATC-TCM Tool" red A04-A1-108 1068: and states the date and time of the event."

In the above example, the wording may indicate that the tool has identified a problem on the A route segment 04 with circuit A1-108. The email may provide the time and date of the occurrence and also the adjusted length of the train that could not fit. The email may include an attachment that graphically represents the event in the manner previously discussed. This nomenclature is consistent with how track circuits may be numbered and identified in all circles at WMATA, for example.

Figure 9:
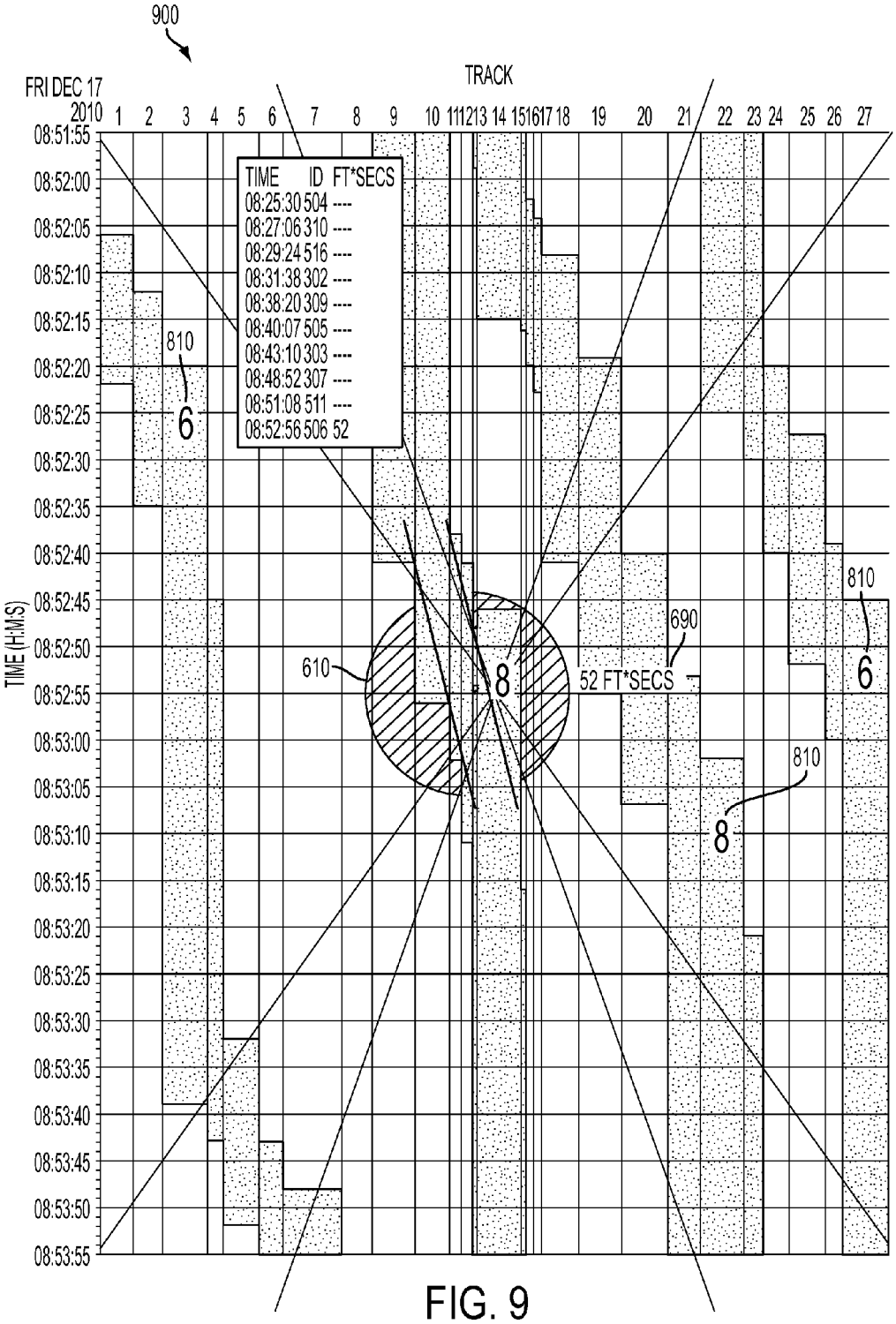
FIG. 9 depicts an illustrative graphical example illustrating a lower severity event.

In FIG. 6, in addition to dot 610 being used to indicate fit failures, the color of dot 610 may be used to indicate the severity level. For example, red may indicate that the badness exceeds 800 ft*seconds. Other colors such as grey, green, orange, etc. may be used for varying severity levels. The sent message (e.g. e-mail) may include the event plot as an attachment that may be viewed by all recipients. Additionally, severity level 690 may indicate the "badness" of the event. For example, in FIG. 6 severity level 690 is 1068 ft*sec, in FIG. 8 the severity level 690 is 1044 ft*sec, while in FIG. 9 the severity level 690 is only 52 ft*sec. The dot 610 may be red in FIGS. 6 and 8, indicating a high severity level, while in FIG. 9, the dot may be green, indicating a low severity event. Rules may be applied to various threshold values of severity to determine which colors should be applied to a graph and when to alert personnel.

Messages via email, instant message, SMS, Twitter, blogs, Facebook, etc. may be sent out periodically per hour, day, week, month, etc. with reports on the LOS or other detected events. For example, twice a day, at 9 AM and 7 PM, the ATC engineers may receive an email message with LOS fit charts for all events since the previous summary email. For example, a summary email may group the events that occurred through the morning rush (e.g., from 7:00:01 pm the previous day to 9:00:00 am the current day) and afternoon rush (e.g., from 9:00:01 am to 7:00:00 pm.) and may publish them to a staff list in accordance with the approved business process for LOS Tool. The LOS fit charts may be geographically organized so that LOS events within a given region may be grouped together. The assigned ATC engineer may review the events and may follow the approved procedures to indicate to the designated staff the assessment of data. As needed the engineer may direct that action be taken in accordance with the approved process if deemed necessary.

Alerts may also be transmitted in real-time or near real-time. As noted above and as may be recognized in a business process, not all events may be critical events that require immediate action to avoid a serious incident. Indications may be reviewed by the automatic train control staff at a specified period (e.g., twice daily). Criteria may be developed that will trigger alarm that may require the action by the operations control center (OCC). Alarm producing criteria may be, for example:

a. Five (5) consecutive events in the same circuit of over 300 ft*seconds b. Three (3) consecutive events in the same circuit of over 800 ft*seconds.

c. Two (2) events in a circuit of over 1500 ft*seconds.

Figure 10:
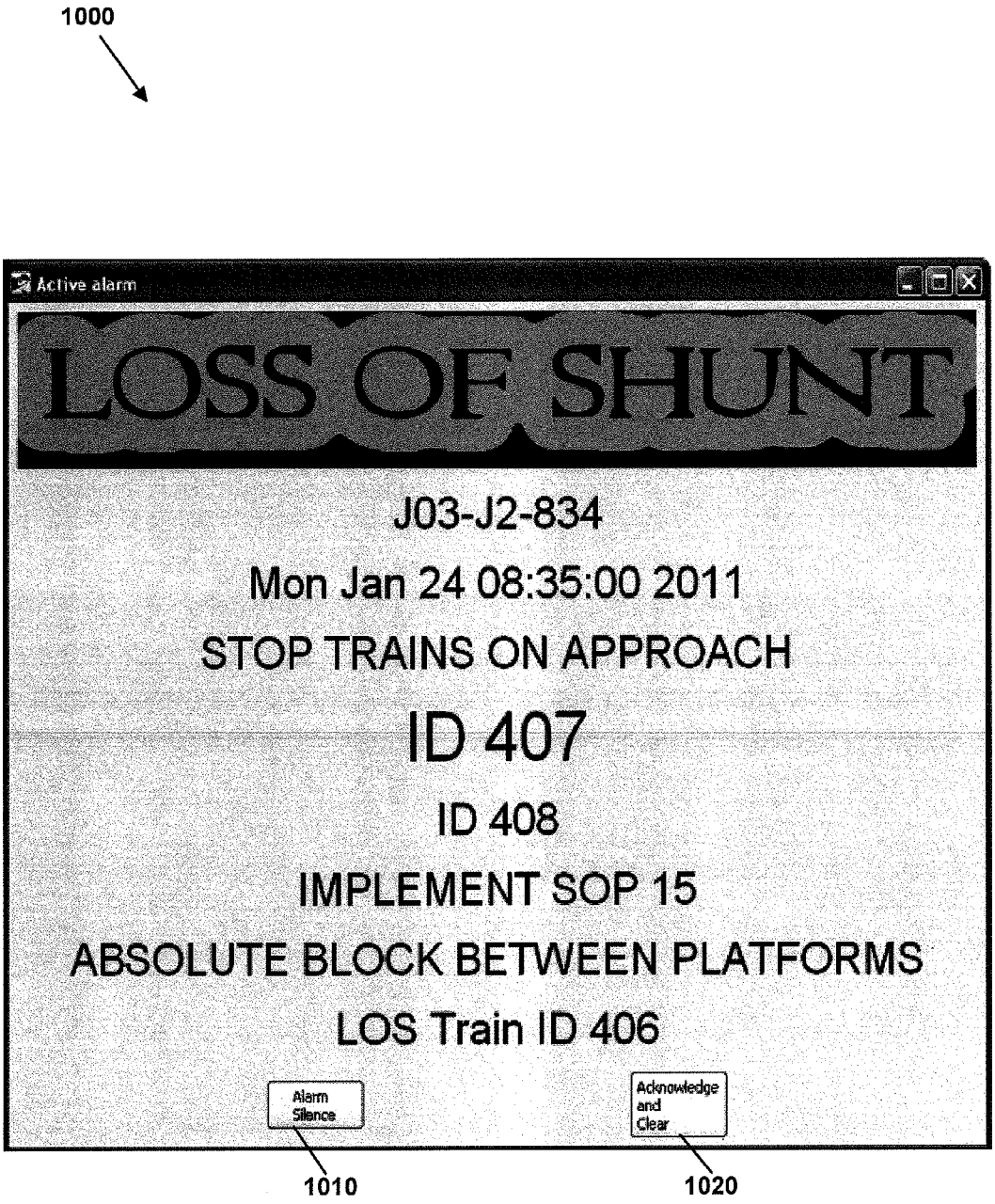
FIG. 10 depicts a sample pop-up graphic and alarm message.

FIG. 10 depicts sample pop-up graphic and alarm message 1000. Pop-up graphic and alarm message 1000 may alert personnel as soon as an event is triggered (e.g., a high severity event) or when a threshold number of events occur (e.g., more than five minor severity events or three medium severity events). When a loss of shunt occurs, alerts may be generated and personnel may be notified. Personnel may be notified through pop-up messages such as sample pop-up graphic and alarm message 1000. Pop-up graphic and alarm message 1000 may include "LOSS OF SHUNT" flashing alarm banner; J03 J2-834—station location and identifier (e.g., name) of the track circuit that set off the RT-LOS Alarm, J-Line outbound track 2, in J03/Franconia-Springfield territory; Day of the week, date, and time of the RT-LOS Alarm event; Message to "Stop Trains On Approach" to the affected area—first of all, the train identified by the flashing ID number directly below this message; ID 407—the train following the LOS incident train, identified by larger font and flashing ID number; ID 408—the train behind train 407; Message to "Implement SOP #15", the Absolute Block Standard Operating Procedure; ID 406—the LOS incident train, i.e. the train ahead that set off the alarm in track circuit J03 J2-834; Alarm Silence button 1010—turns off the audible alarm and may enable the "Acknowledge and Clear" button 1020. The Acknowledge and Clear button—when enabled, turns off the strobe alarm and removes alarm pop-up graphic from console display. The Acknowledge and Clear button 1020 may be initially disabled (i.e. greyed out), and may be enabled after clicking the Alarm Silence button.

FIG. 11 depicts sample automatic email alert 1100 which may be sent out, for example, when an event occurs and/or when personnel require notification.

The short term performance of the circuits may be tracked by software to assess the parameters described above and may detect circuits that are repeatedly producing false occupancies or vacancies even though less severe. When alarm producing criteria are met, an alarm may be produced that may be enunciated both visually and audibly in the Operations Control Center (OCC), for example. This indication may set in motion a series of actions starting with the OCC where the Assistant Superintendent, for example, may take steps to protect train movement in the area and ensure safe train separation.

Testing for the inventions described in this document has been performed using the vast amount of stored data in the WMATA system. Known anomalies have been identified and the data for these instances have been gathered to form a suite of data that is used to test the software and software modifications in order to verify satisfactory performance.

Servers may run software to monitor approximately 3000 track circuits each time a train passes through it. Over 1.8 million indications may be evaluated each day. The servers may be located in at least two separate locations and may be redundant at each location. The servers may be monitored by an Information Technology Department at the central data center, for example. A self check routine and indication may be provided for each server to provide verification that the software is running effectively.

Routine conditions such as circuits that are out of adjustment, have loose connections, broken clamps or damaged bonds may be identified immediately after the first train exits the diminished track circuit. This may allow engineering and maintenance staff to inspect the specific track circuit, locate the problem and correct it before it becomes a major problem or before the next scheduled maintenance or inspection for that segment of track.

In tests, conditions such as parasitic oscillation, corrugated rail, bad RTU status indication, and a failed ATP module circuit board have been identified allowing staff to perform corrective work or schedule rail grinding with the appropriate maintenance department in a timely manner. The software may be valuable in helping staff to focus investigations, inspections and corrective maintenance when needed particularly between scheduled maintenance. The system may actively monitor trains and train tracks and potential problems may be addressed before a failure occurs.

Figure 12:
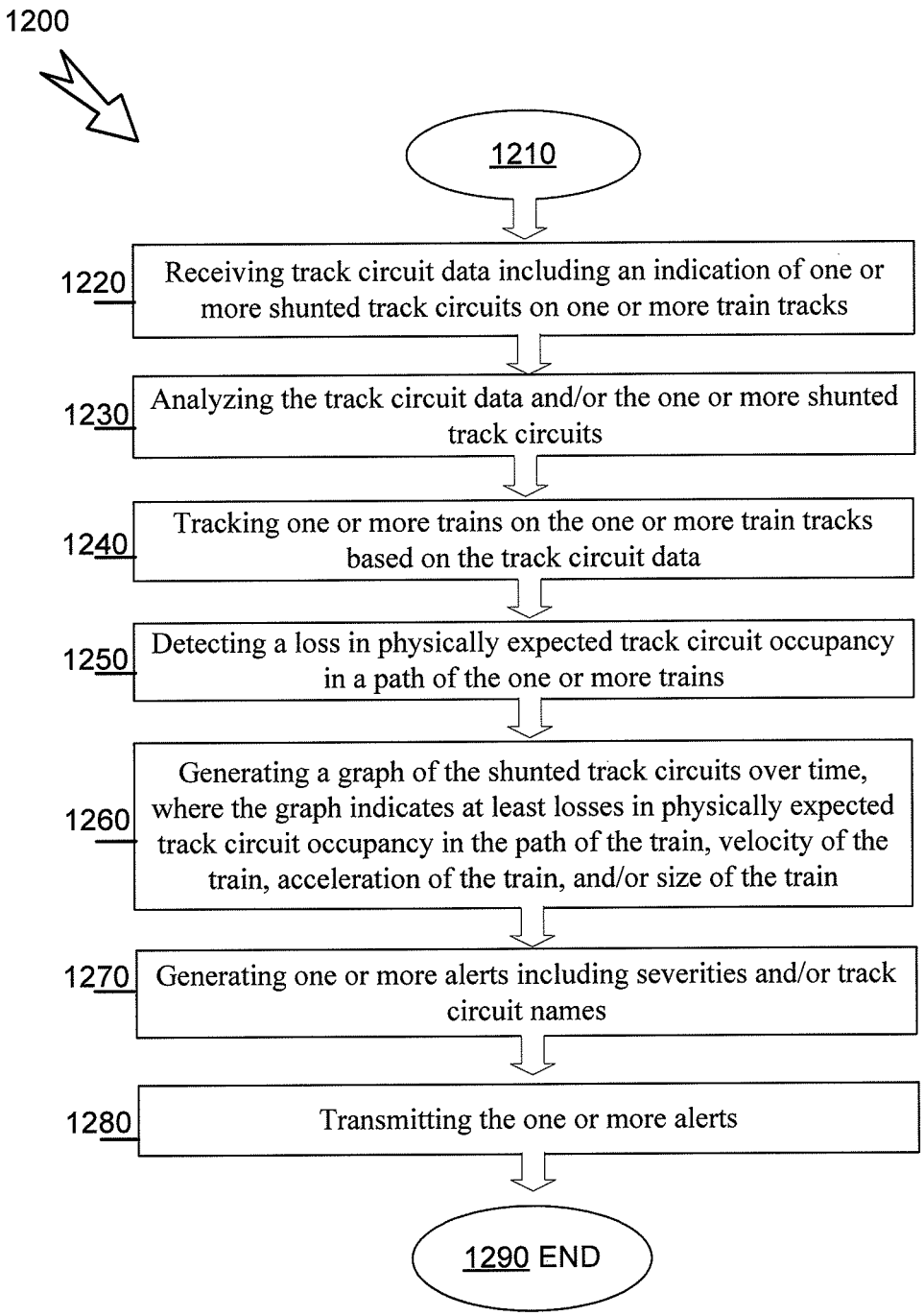
FIG. 12 depicts an illustrative workflow for train monitoring.

FIG. 12 depicts an illustrative workflow for train control and monitoring. Flow may start at 1210 and move directly to 1220. At 1220, track circuit data may be received. The track circuit data may include an indication of one or more shunted track circuits on one or more train track to be monitored. From 1220, flow may move to 1230.

At 1230, the received track circuit data and/or shunted track circuits may be analyzed. From 1230, flow may move to 1240.

At 1240, one or more trains may be tracked on the one or more train tracks based on the track circuit data and/or shunted track circuits. From 1240, flow may move to 1250.

At 1250, a loss in physically expected track circuit occupancy in the path of the one or more trains may be detected. When a loss is detected, speed control commands may be transmitted to the train or to a train control system. The speed control commands may be based on the analysis of the received track circuit data and/or the shunted track circuits. From 1250, flow may move to 1260.

At 1260, a graph of the shunted track circuits over time may be generated. The graph may indicate, for example, losses in physically expected track circuit occupancy in the path of the train, velocity of the train, acceleration of the train, and/or size of the train. From 1260, flow may move to 1270.

At 1270, one or more alerts may be generated based on the analysis of the received track circuit data and/or the shunted track circuits. The alerts may include the issue detected, the severity of the issue detected, and/or the track circuit identifier where the issue was detected. From 1270, flow may move to 1280.

At 1280, the one or more alerts may be transmitted to one or more receivers. From 1280, flow may more to 1290 and end.

Figure 13:
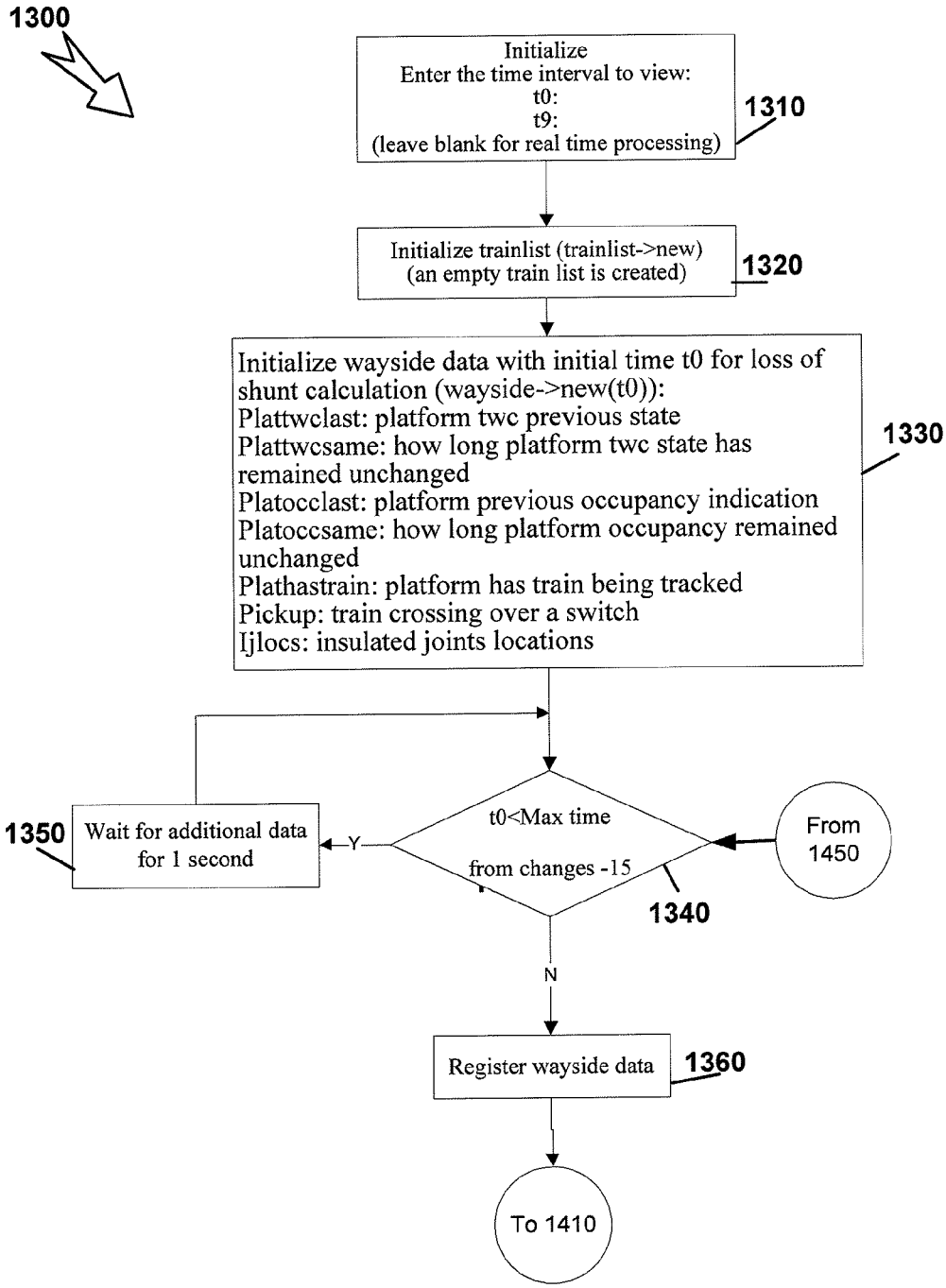
FIG. 13 depicts an illustrative logic flow chart in an illustrative embodiment.

FIG. 13 depicts illustrative logic flow chart 1300 representing an illustrative embodiment. Logic flow chart 1300 demonstrates an example logic flowchart which may be used in, for example, a illustrative software embodiment.

Flow may start at 1310 where a time interval may be entered and/or computed. From 1310, flow may move to 1320.

At 1320, a list of trains to track and analyze may be initialized. From 1320, flow may move to 1330.

At 1330, data may be collected, computed, and/or analyzed. From 1330, flow may move to 1340.

At 1340, if a time limit has been reached then flow may move to 1360. If the time has not expired, flow may move to 1350 to wait for additional data. Flow may also be received here from FIG. 14. 1450.

Figure 14:
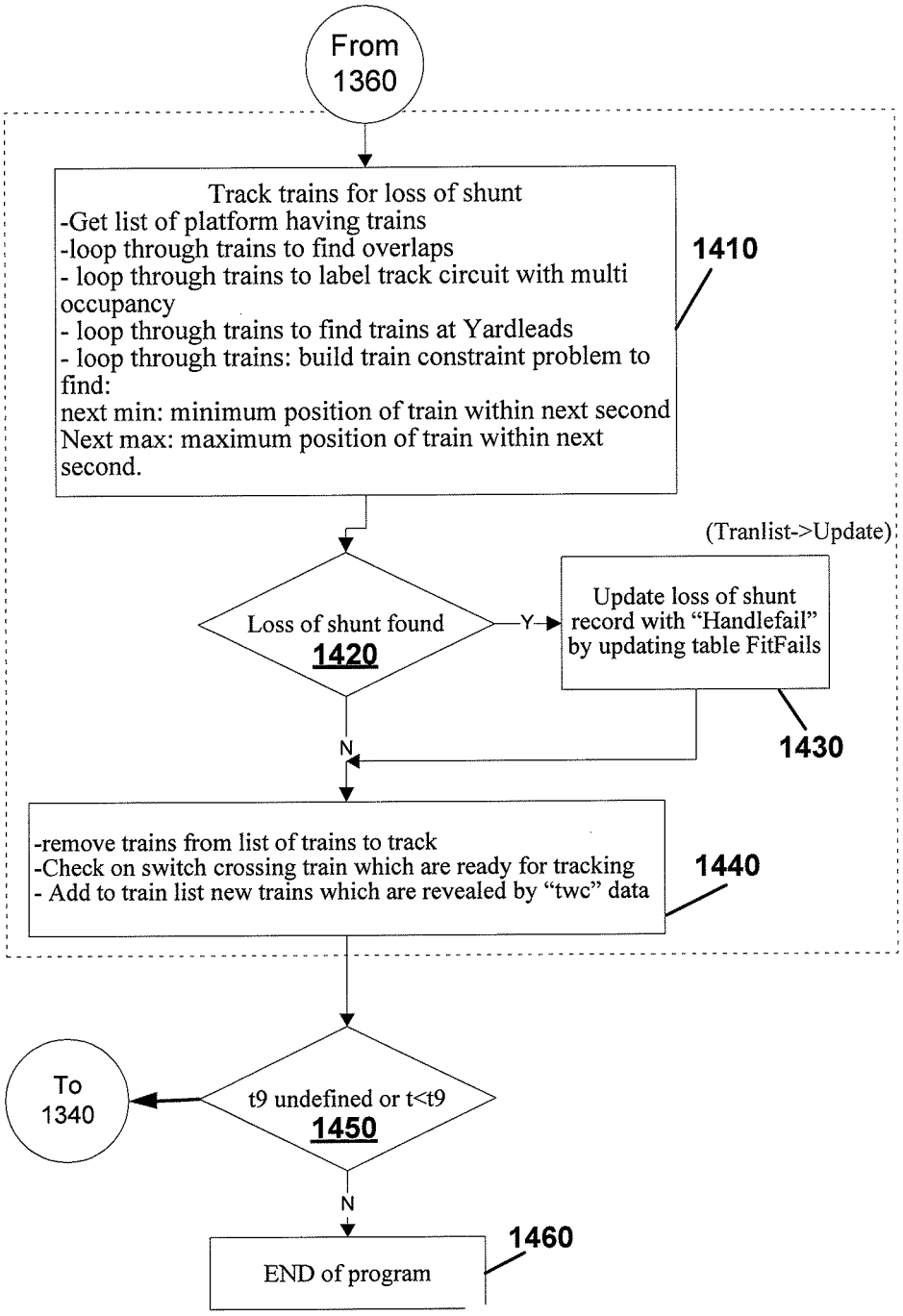
FIG. 14 continues to depict the illustrative logic flow chart in an illustrative embodiment.

At 1360, wayside data may be registered and flow may move to FIG. 14. 1410.

FIG. 14 depicts a illustrative logic flow chart 1400 representing a flow continuation from illustrative logic flow chart 1300 demonstrates. Flow may begin at 1410 which may be a continuation from 1360. At 1410, trains may be tracked for a loss of shunt. From 1410, flow may move to 1420.

At 1420, if a loss of shunt is detected, flow may move to 1430. If no loss of shunt is detected, flow may move to 1450.

At 1430, a loss of shunt record is updated and the loss of shunt is recorded. From 1430, flow may move to 1440.

At 1440, trains may be removed from the list of trains to track, the system may check on any switch crossing trains that may be ready for tracking, and/or new trains may be added to the list of trains to track. From 1440, flow may move to 1450.

Figure 15:
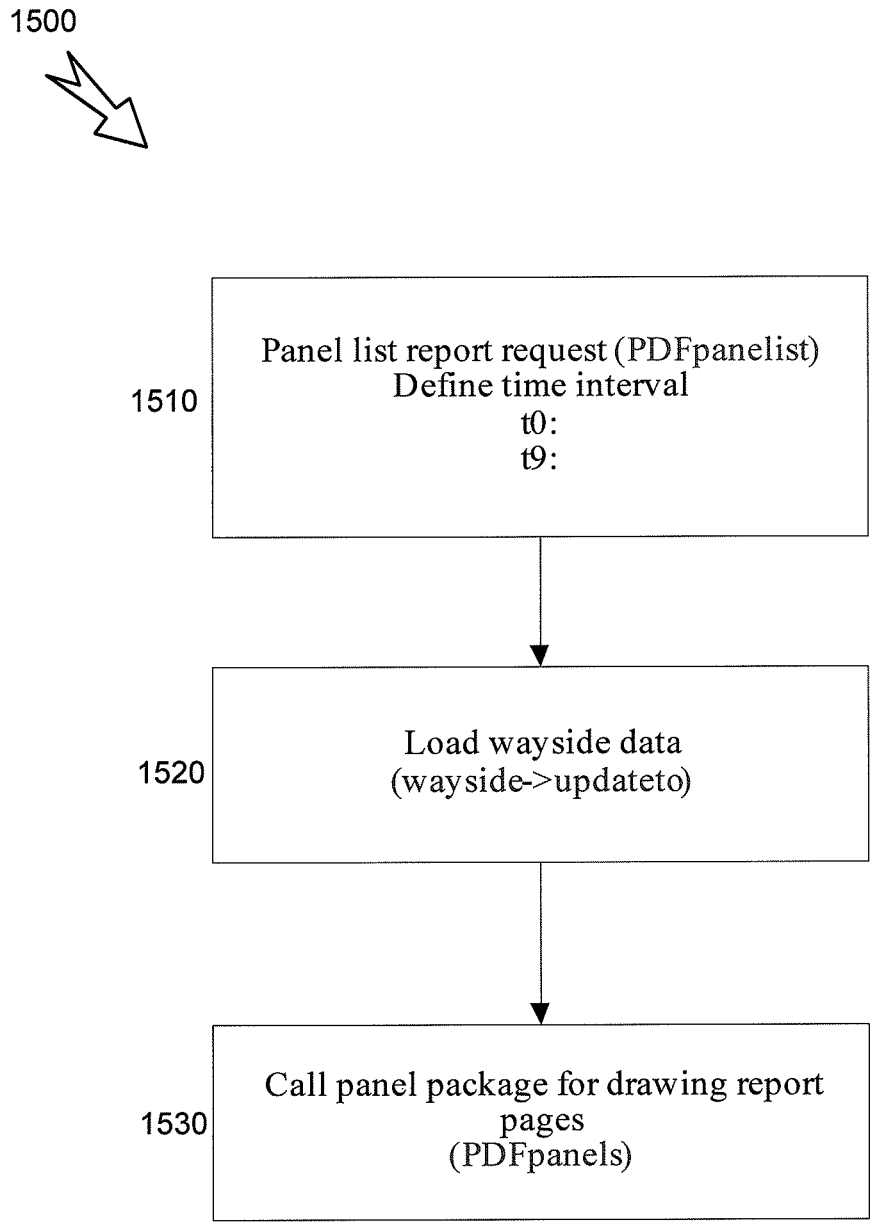
FIG. 15 depicts an illustrative reporting flow chart in an illustrative embodiment.

At 1450, if there are no more trains to track the flow moves to 1460 and ends. If trains still require tracking, flow moves back to 1340, FIG. 15 depicts illustrative reporting flow chart 1500 representing an illustrative embodiment. Reporting flow chart 1500 demonstrates an example logic flowchart which may be used in, for example, a illustrative software embodiment.

Flow may start at 1510, where a report request may be received. The report request may include, for example, a train track identifier and a time period. From 1510, flow may move to 1520.

At 1520, wayside data may be loaded that corresponds to the data in the report request. From 1520, flow may move to 1530.

At 1530, a panel package for drawing report pages may be called.

Figure 16:
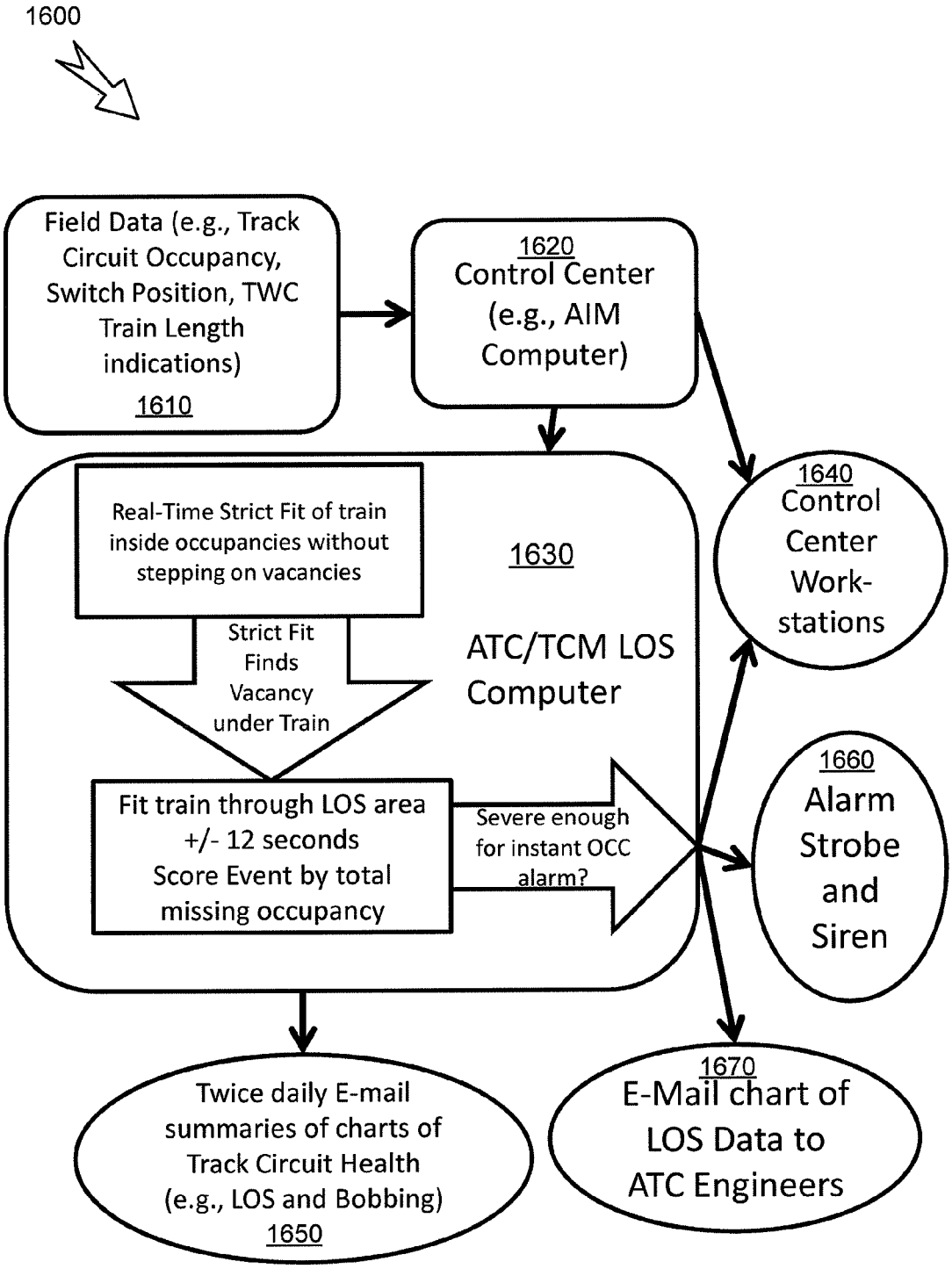
FIG. 16 depicts an illustrative workflow for an illustrative embodiment train monitoring system.

FIG. 16 depicts an illustrative workflow 1600 for an illustrative embodiment train control and monitoring system. Flow may begin at 1610 with the acquisition of field data. Field data may include track circuit occupancy, switch position, TWC train length, etc. Flow may then move from 1610 to 1620.

At 1620, a computer, such as a control center AIM computer, may receive field data from 1610. From 1620, flow may move to 1630 and/or 1640.

At 1630, a computer such as a computer running ATC/TCM LOS software may receive field data. The software may analyze the data for real-time (or near real time) strict fit of train inside occupied track circuits without the train stepping on vacant circuits. If there is a vacancy under the train, the computer may attempt to fit the train through the LOS area +/−12 seconds, for example, and come up with a severity or badness score. If the score is severe enough (e.g., reaches or exceeds a pre-defined threshold) an instant alarm may trigger and flow may move to 1640, 1660, and/or 1670.

At 1640, control center workstations, for example, receive data from the field, data from 1630, and/or any instant alarm data from 1630.

At 1650, an email indicating train and track status may be sent out periodically or may be triggered by an event.

At 1660, if the severity reaches or exceeds the threshold of 1640, an alarm strobe and siren may occur.

At 1670, if the severity reaches or exceeds the threshold of 1640, an email or instant message may be sent out to engineers and other personnel.

Figure 17:
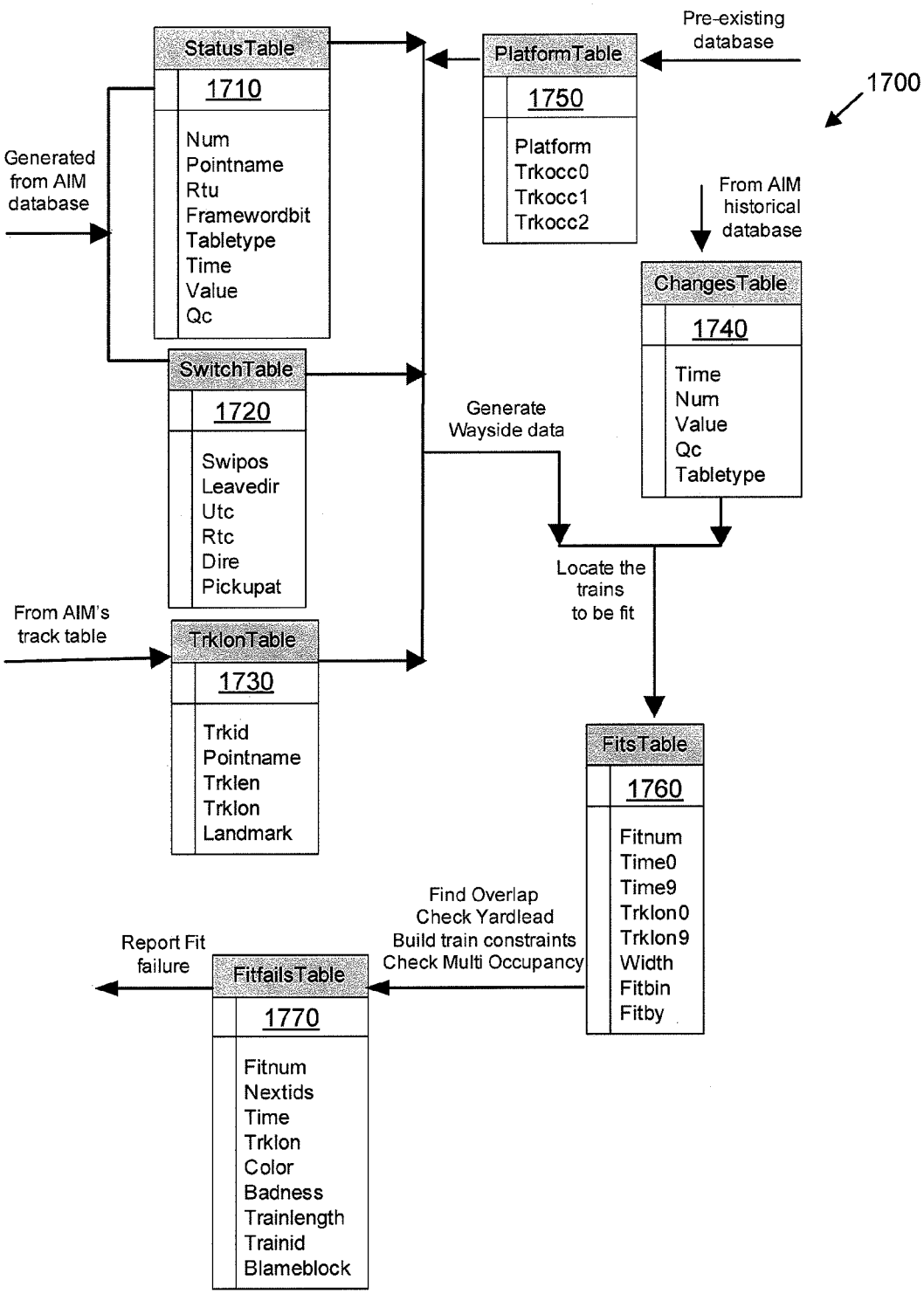
FIG. 17 depicts an illustrative database relationship chart in an illustrative embodiment.

FIG. 17 depicts illustrative database relationship chart 1700 representing an illustrative embodiment. Database relationship chart 1700 contains the following tables.

Status table 1710 may be a table that establishes a link to status data (e.g., AIM status data) and may be generated from an existing status database (e.g., AIM status database). Status table 1710 may be used to generate the wayside data for loss of shunt (LOS) calculation. Status table 1710 may include the following eight columns. Three columns "Num," "Pointname," and "Tabletype" may be used by a LOS tool, such as described herein.

Num: Index number
Pointname: Point type+track circuit identification
Rtu: RTU number
Framewordbit: Current status or analog frame word
Tabletype: "S" indicates "status", "A" indicated "Analog"
Time: Universal time
Value: Depending on the point type (indicated by "Pointname"), comply with point type and its corresponding value definition in RTU scan sheet.
Qc: RTU quality code, "0" indicates "running/ok", "1" indicates "down"

Figure 18:
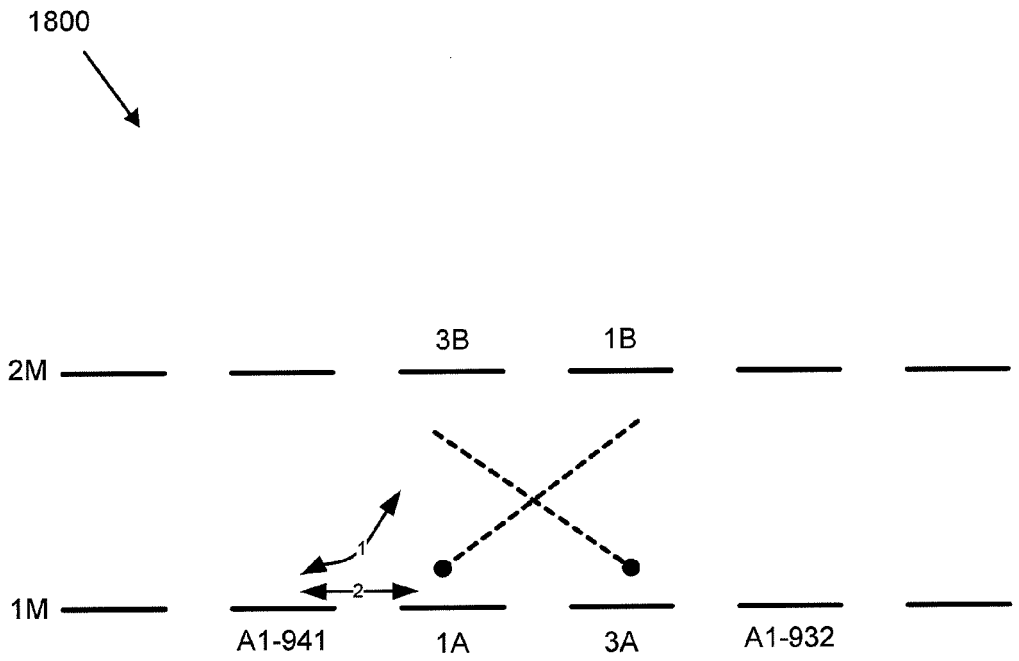
FIG. 18 depicts an illustrative rail switch.

Switch table 1720 may use data from a database that provides a list of all rail switches. FIG. 18 illustrates illustrative rail switch 1800. Switch table 1720 may be used to generate the wayside data for LOS calculation. Switch table 1720 may include the following six columns.

Swipos: AIM Switch position identification
Leavedir: Position of the switch for the train leaving the territory. "1" indicates "Diverse" position, "2" indicates "Normal straight through" position (See FIG. 18 illustrative rail switch 1800)
Utc: Connected universal track circuit
Rtc: Connected reverse track circuit
Dire: Train moving direction, "L" indicates "left bound", "R" indicates "right bound"
Pickupat: Track circuit associated with the switch Trklon table 1730 may use data from a database of track circuits. Trklon table 1730 may be used to generate the wayside data for LOS calculation. Trklon table 1730 may contain the following five columns.

Trkid: AIM Track circuit identification
Pointname: Point type+track circuit identification
Trklen: Track length travelled, change of the occupancy. This number is indicated by the difference between left and right edge of the occupancy data block on the graph.
Trklon: Track length indication in the direction of travel, this number is indicated by the left edge of the occupancy data block on the graph.
Landmark: Any special landmark objects helping to identify the location, such as platform, yard, etc. Set it to be NULL for the track circuits between the landmarks.

Changes table 1740 may use data from a database that stores the change of occupancy. It may be generated from an existing database (e.g., AIM historical database DBCHANOF) and identified trains table 1760. Changes table 1740 may be scanned for trains indicating valid length and occupancy and this may result in the list of identified trains table 1760. Changes table 1740 may include the following five columns.

Time: Universal time
Num: Index number
Value: Depending on the point type (indicated by "Pointname"), comply with point type and its corresponding value definition in RTU scan sheet.
Qc: RTU quality code, "0" indicates "running/ok", "1" indicates "down"
Tabletype: S" indicates "status", "A" indicates "Analog"

Platform table 1750 may use data from a list of all platforms and associated track circuits. Platform table 1750 may be used to generate the wayside data for LOS calculation. Platform table 1750 may include the following four columns. One column "trkocc1" may be used by a LOS tool.

Platform: Platform identification
Trkocc0: Track circuit before the platform
Trkocc1: Track circuit indicating the actual platform occupancy
Trkocc2: Track circuit after the platform Identified trains table 1760 may use data from a database keeping a record of trains being fit as may be determined by a LOS tool. Identified trains table 1760 may be used by for the LOS calculation to identify trains for fit failure. Identified trains table 1760 may include the following eight columns.

Fitnum: Index number to tie a fit with "fitfails" table
Time0: The beginning time of the fit
Time9: The end time of the fit
Trklon0: The minimum trklon of the fit
Trklon9: The maximum trklon of the fit
Width: Length (in ft) of the train that is being fit
Fitbin: Train position change from start to end of the fit
Fitby: The fit method (loose fit or strict fit)

Fitfalls table 1770 may use data from an output database written by the LOS tool which may keep a record of all fit failures and loose fit output. Fitfalls table 1770 may include the following eight columns.

Fitnum: Index number to tie a fit with "fits" table
Nextids: next two train IDs, which can be used to trigger warning to the following two trains
Time: Universal time
Trklon: Track length indication in the direction of travel, this number is indicated by the left edge of the occupancy data block on the graph.
Color: Fit failure indication. "Red" indicates "above 800 ft" badness, "Orange" indicates "between 100 ft and 800 ft" badness, "darkgreen" indicated "below 100 ft" badness
Badness: Indicates the fit failure in ft*sec of missing train occupancy found by the loose fit method
Trainlength: Length (in ft) of the train that is being fit
Trainid: ID of the train that is identified by strict fit method
Blameblock: The block of track circuit that is identified to cause the fit failure The following software modules may be used in an embodiment of the invention.

A registry module may define how wayside objects are associated to the RTU that transmit data for discrete segments of the railroad and train control rooms to the AIM computers, for example.

A wayside module may keep a list of railroad configuration objects, which may include track circuits, platforms, switch positions, and blocks of occupancy. This module may also define the relationship between track circuits, the relationship between track circuit and platforms, and the relationship between track circuits and switch positions.

A trainlist module may provide a list of trains that are being identified to be "fit." LOS tools may then perform calculations to identify a "fit failure."

A train module may contain sub-modules to identify the overlaps, to label multi occupancy, to check Yardleads, and build train constraints for fit calculation. When the train module is combined with wayside modules, a fit failure may be identified.

A pdfpanels module may load wayside data and generate final report pages.

Figure 1C:
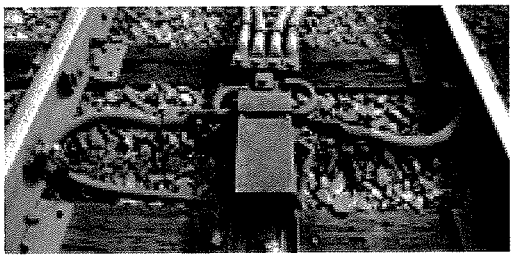
Figure 19:
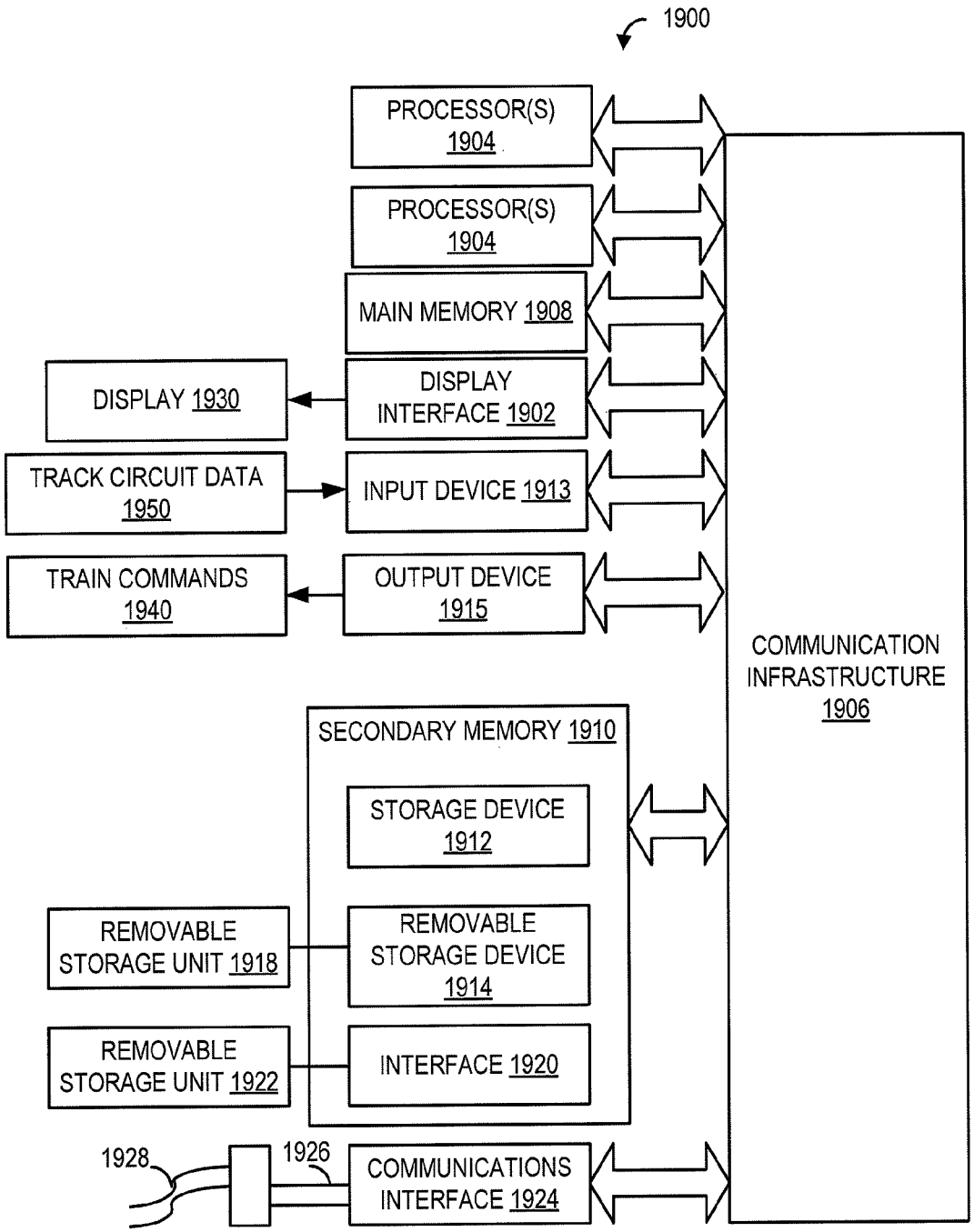
FIG. 19 depicts an illustrative computer system that may be used in implementing an illustrative embodiment.

FIG. 19 depicts illustrative computer system 1900 that may be used in implementing an illustrative embodiment of the embodiments described herein. Specifically, FIG. 19 depicts an illustrative embodiment of computer system 1900 that may be used in computing devices such as, e.g., but not limited to, standalone, client, or server devices and/or the devices described in FIGS. 1-3. FIG. 19 depicts an illustrative embodiment of a computer system 1900 that may be used as client device, a server device, a database server, etc. The present invention (or any part(s) or function(s) thereof) may be implemented using hardware, software, firmware, or a combination thereof and may be implemented in one or more computer systems or other processing systems. In fact, in one illustrative embodiment, the invention may be directed toward one or more computer systems capable of carrying out the functionality described herein. Example computer system 1900 is shown in FIG. 19, depicting an illustrative embodiment of a block diagram of an illustrative computer system useful for implementing the present invention. Specifically, FIG. 19 illustrates an example computer 1900, which in an illustrative embodiment may be, e.g., (but not limited to) an embedded device, a Motorola Xoom tablet, an Apple iPad, a personal computer (PC) system running an operating system such as, e.g., (but not limited to) MICROSOFT® WINDOWS® NT/98/2000/XP/Vista/Windows 7/etc. available from MICROSOFT® Corporation of Redmond, Wash., U.S.A. or an Apple computer executing MAC® OS from Apple® of Cupertine, Calif., U.S.A, a mainframe. However, the invention is not limited to these platforms. Instead, the invention may be implemented on any appropriate computer system running any appropriate operating system. In one illustrative embodiment, the present invention may be implemented on a computer system operating as discussed herein. Other components of the invention, such as, e.g., (but not limited to) a computing device, a communications device, a telephone, a personal digital assistant (PDA), an iPhone, an IPad, a 3/4G wireless device, a wireless device, a personal computer (PC), a handheld PC, a laptop computer, a smart phone, a mobile device, a netbook, a handheld device, a portable device, an interactive television device (iTV), a digital video recorder (DVR), client workstations, thin clients, thick clients, fat clients, proxy servers, network communication servers, remote access devices, client computers, server computers, peer-to-peer devices, routers, web servers, data, media, audio, video, telephony or streaming technology servers, etc., may also be implemented using a device such as that shown in FIG. 19.

Computer system 1900 may include one or more processors, such as, e.g., but not limited to, processor(s) 1904. The processor(s) 1904 may be connected to a communication infrastructure 1906 (e.g., but not limited to, a communications bus, cross-over bar, interconnect, or network, etc.). Processor 1904 may include any type of processor, microprocessor and/or processing logic that may interpret and execute instructions (e.g., for example, a field programmable gate array (FPGA)). Processor 1904 may comprise a single device (e.g., for example, a single core) and/or a group of devices (e.g., multi-core). The processor 1904 may include logic configured to execute computer-executable instructions configured to implement one or more embodiments. The instructions may reside in main memory 1908 or a secondary memory 1910. Processors 1904 may also include multiple independent cores, such as a dual-core processor or a multi-core processor. Processors 1904 may also include one or more graphics processing units (GPU) which may be in the form of a dedicated graphics card, an integrated graphics solution, and/or a hybrid graphics solution. Various illustrative software embodiments may be described in terms of this illustrative computer system. After reading this description, it will become apparent to a person skilled in the relevant art(s) how to implement the invention using other computer systems and/or architectures.

Computer system 1900 may include a display interface 1902 that may forward, e.g., but not limited to, graphics, text, and other data, etc., from the communication infrastructure 1906 (or from a frame buffer, etc., not shown) for display on the display unit 1930. The display unit 1930 may be, for example, a television, a computer monitor, or a mobile phone screen. The output may also be provided as sound through a speaker. Display unit 1930 may display graphs such as those in FIGS. 4-9, alerts such as FIG. 10, and emails such as FIG. 11.

The computer system 1900 may also include, e.g., but is not limited to, a main memory 1908, random access memory (RAM), and a secondary memory 1910, etc. Main memory 1908, random access memory (RAM), and a secondary memory 1910, etc., may be a computer-readable medium that may be configured to store instructions configured to implement one or more embodiments and may comprise a random-access memory (RAM) that may include RAM devices, such as Dynamic RAM (DRAM) devices, flash memory devices, Static RAM (SRAM) devices, etc.

The secondary memory 1910 may include, for example, (but is not limited to) a hard disk drive 1912 and/or a removable storage drive 1914, representing a floppy diskette drive, a magnetic tape drive, an optical disk drive, a compact disk drive CD-ROM, flash memory, etc. The removable storage drive 1914 may, e.g., but is not limited to, read from and/or write to a removable storage unit 1918 in a well-known manner. Removable storage unit 1918, also called a program storage device or a computer program product, may represent, e.g., but is not limited to, a floppy disk, magnetic tape, optical disk, compact disk, etc. which may be read from and written to removable storage drive 1914. As will be appreciated, the removable storage unit 1918 may include a computer usable storage medium having stored therein computer software and/or data. Main memory 1908 and/or secondary memory 1910 may hold one or more databases, tables such as those listed in FIG. 17, and software modules listed herewith.

In alternative illustrative embodiments, secondary memory 1910 may include other similar devices for allowing computer programs or other instructions to be loaded into computer system 1900. Such devices may include, for example, a removable storage unit 1922 and an interface

1920. Examples of such may include a program cartridge and cartridge interface (such as, e.g., but not limited to, those found in video game devices), a removable memory chip (such as, e.g., but not limited to, an erasable programmable read only memory (EPROM), or programmable read only memory (PROM) and associated socket, and other removable storage units 1922 and interfaces 1920, which may allow software and data to be transferred from the removable storage unit 1922 to computer system 1900.

Computer 1900 may also include an input device 1913 may include any mechanism or combination of mechanisms that may permit information to be input into computer system 1900 from, e.g., a user. Input device 1913 may include logic configured to receive information for computer system 1900 from, e.g. a user. Examples of input device 1913 may include, e.g., but not limited to, a mouse, pen-based pointing device, or other pointing device such as a digitizer, a touch sensitive display device, and/or a keyboard or other data entry device (none of which are labeled). Other input devices 1913 may include, e.g., but not limited to, a biometric input device, a video source, an audio source, a microphone, a web cam, a video camera, and/or other camera. Input device 1913 may communicate with processor 1904 either wired or wirelessly. Input device 1913 may also include input from track circuit data 1950 from, for example, impedance bonds 100*a* 100*b*, transmitter 230, transmitter 250, receiver 240, receiver 260, and other devices.

Computer 1900 may also include output devices 1915 which may include any mechanism or combination of mechanisms that may output information from computer system 1900. Output device 1915 may include logic configured to output information from computer system 1900. Embodiments of output device 1915 may include, e.g., but not limited to, display 1930, and display interface 1902, including displays, printers, speakers, cathode ray tubes (CRTs), plasma displays, light-emitting diode (LED) displays, liquid crystal displays (LCDs), printers, vacuum florescent displays (VFDs), surface-conduction electron-emitter displays (SEDs), field emission displays (FEDs), etc. Computer 1900 may include input/output (I/O) devices such as, e.g., (but not limited to) communications interface 1924, cable 1928 and communications path 1926, etc. These devices may include, e.g., but are not limited to, a network interface card, and/or modems. Output device 1915 may communicate with processor 1904 either wired or wirelessly. Output device 1915 may also output data for train commands 1940. Output device 1915 may send data to, for example, impedance bonds 100*a* 100*b*, transmitter 230, transmitter 250, receiver 240, receiver 260, and other devices.

Communications interface 1924 may allow software and data to be transferred between computer system 1900 and external devices.

In this document, the terms "computer program medium" and "computer readable medium" may be used to generally refer to media such as, e.g., but not limited to, removable storage drive 1914, a hard disk installed in hard disk drive 1912, flash memories, removable discs, non-removable discs, etc. In addition, it should be noted that various electromagnetic radiation, such as wireless communication, electrical communication carried over an electrically conductive wire (e.g., but not limited to twisted pair, CAT5, etc.) or an optical medium (e.g., but not limited to, optical fiber) and the like may be encoded to carry computer-executable instructions and/or computer data that embodiments of the invention on e.g., a communication network. These computer program products may provide software to computer system 1900. It should be noted that a computer-readable medium that comprises computer-executable instructions for execution in a processor may be configured to store various embodiments of the present invention. References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic.

Further, repeated use of the phrase "in one embodiment," or "in an illustrative embodiment," do not necessarily refer to the same embodiment, although they may.

Unless specifically stated otherwise, as apparent from the following discussions, it is appreciated that throughout the specification discussions utilizing terms such as "processing," "computing," "calculating," "determining," or the like, refer to the action and/or processes of a computer or computing system, or similar electronic computing device, that manipulate and/or transform data represented as physical, such as electronic, quantities within the computing system's registers and/or memories into other data similarly represented as physical quantities within the computing system's memories, registers or other such information storage, transmission or display devices.

In a similar manner, the term "processor" may refer to any device or portion of a device that processes electronic data from registers and/or memory to transform that electronic data into other electronic data that may be stored in registers and/or memory. A "computing platform" may comprise one or more processors.

Embodiments of the present invention may include apparatuses for performing the operations herein. An apparatus may be specially constructed for the desired purposes, or it may comprise a general purpose device selectively activated or reconfigured by a program stored in the device.

Embodiments may be embodied in many different ways as a software component. For example, it may be a stand-alone software package, or it may be a software package incorporated as a "tool" in a larger software product. It may be downloadable from a network, for example, a website, as a stand-alone product or as an add-in package for installation in an existing software application. It may also be available as a client-server software application, or as a web-enabled software application.

According to another embodiment, embodiments may be represented by any of a number of well-known network architecture designs including, but not limited to, peer-to-peer, client-server, hybrid-client (e.g., thin-client), or standalone.

In another embodiment, a strict loss of shunt fit may be implemented using the following techniques.

The loss of shunt search method called the "strict fit" may apply three sets of constraints for up to 30 seconds. The constraints may be based on:

1. Trains are not allowed to step on vacant track circuits anywhere under their length.

2. Trains maximum velocity is limited to +/−120 feet per second.

3. Trains maximum acceleration is limited to +/−5 feet per second squared.

Constraint 1 may be applied using, for example, known train length from Train-to-Wayside reads. Each car may be 75 feet long; trucks are inset a total of 16 feet from each end; and an extra 50 feet may be allowed.

Constraints 2 and 3 may be chosen to model the maximum physical performance of Metrorail revenue-class vehicles, for example. The maximum velocity of such a vehicle may be 120 feet per second (79 miles per hour). 5 feet per second squared may be the maximum acceleration/deceleration rate (3.4 Miles per hour per second).

Coordinates may be expressed in feet in this document; the convention may be that distance coordinates increase in the normal direction on track 1 ("rightbound" movement as seen on a track chart or OCC computer screen) and distance coordinates decrease in the normal direction on track 2 ("leftbound" movement). Thirty seconds of occupancy data, for example, is used to write a set of 30 equations constraining the coordinates (called "x" here) of the train to stay on occupied track. For an example chart of a 6 car train moving leftbound through B03 on track 2, the equations are:

Position constraint: $2102176<x_1<2102465$ (ft)
Position constraint: $2102176<x_2<2102465$ (ft)
Position constraint: $2102176<x_3<2102465$ (ft)
Position constraint: $2102176<x_4<2102465$ (ft)
Position constraint: $2102176<x_5<2102465$ (ft)
Position constraint: $2102176<x_6<2102465$ (ft)
Position constraint: $2102176<x_7<2102465$ (ft)
Position constraint: $2102176<x_8<2102465$ (ft)
Position constraint: $2102176<x_9<2102465$ (ft)
Position constraint: $2102176<x_{10}<2102465$ (ft)
Position constraint: $2102176<x_{11}<2102465$ (ft)
Position constraint: $2102002<x_{12}<2102465$ (ft)
Position constraint: $2102002<x_{13}<2102465$ (ft)
Position constraint: $2102002<x_{14}<2102465$ (ft)
Position constraint: $2102002<x_{15}<2102465$ (ft)
Position constraint: $2102002<x_{16}<2102465$ (ft)
Position constraint: $2101766<x_{17}<2102465$ (ft)
Position constraint: $2101766<x_{18}<2102465$ (ft)
Position constraint: $2101766<x_{19}<2102465$ (ft)
Position constraint: $2101766<x_{20}<2102465$ (ft)
Position constraint: $2101766<x_{21}<2102465$ (ft)
Position constraint: $2101445<x_{22}<2102465$ (ft)
Position constraint: $2101445<x_{23}<2101865$ (ft)
Position constraint: $2101445<x_{24}<2101792$ (ft)
Position constraint: $2101445<x_{25}<2101792$ (ft)
Position constraint: $2101445<x_{26}<2101792$ (ft)
Position constraint: $2101445<x_{27}<2101792$ (ft)
Position constraint: $2101031<x_{28}<2101618$ (ft)
Position constraint: $2101031<x_{29}<2101618$ (ft)
Position constraint: $2101031<x_{30}<2101618$ (ft)

Velocity is the first derivative of position. The loss of shunt tool may work with a granularity in time of one second; finite differences of the position variables referenced above, are used to write 29 equations limiting train velocity. The relationship between first derivatives and first differences is as follows:

Only three forms are commonly considered: forward, backward, and central differences.

A forward difference is an expression of the form $$\Delta_h[f](x)=f(x+h)-f(x).$$

Depending on the application, the spacing h may be variable or constant.

The derivative of a function $f$ at a point x is defined by the limit $$f'(x) = \lim_{h\to 0}\frac{f(x+h)-f(x)}{h}.$$

The equations constraining velocity are thus:

Velocity constraint: $-120<(x_2-x_1)<120$ (ft/sec)
Velocity constraint: $-120<(x_3-x_2)<120$ (ft/sec)
Velocity constraint: $-120<(x_4-x_3)<120$ (ft/sec)
Velocity constraint: $-120<(x_5-x_4)<120$ (ft/sec)
Velocity constraint: $-120<(x_6-x_5)<120$ (ft/sec)
Velocity constraint: $-120<(x_7-x_6)<120$ (ft/sec)
Velocity constraint: $-120<(x_8-x_7)<120$ (ft/sec)
Velocity constraint: $-120<(x_9-x_8)<120$ (ft/sec)
Velocity constraint: $-120<(x_{10}-x_9)<120$ (ft/sec)
Velocity constraint: $-120<(x_{11}-x_{10})<120$ (ft/sec)
Velocity constraint: $-120<(x_{12}-x_{11})<120$ (ft/sec)
Velocity constraint: $-120<(x_{13}-x_{12})<120$ (ft/sec)
Velocity constraint: $-120<(x_{14}-x_{13})<120$ (ft/sec)
Velocity constraint: $-120<(x_{15}-x_{14})<120$ (ft/sec)
Velocity constraint: $-120<(x_{16}-x_{15})<120$ (ft/sec)
Velocity constraint: $-120<(x_{17}-x_{16})<120$ (ft/sec)
Velocity constraint: $-120<(x_{18}-x_{17})<120$ (ft/sec)
Velocity constraint: $-120<(x_{19}-x_{18})<120$ (ft/sec)
Velocity constraint: $-120<(x_{20}-x_{19})<120$ (ft/sec)
Velocity constraint: $-120<(x_{21}-x_{20})<120$ (ft/sec)
Velocity constraint: $-120<(x_{22}-x_{21})<120$ (ft/sec)
Velocity constraint: $-120<(x_{23}-x_n)<120$ (ft/sec)
Velocity constraint: $-120<(x_{24}-x_{23})<120$ (ft/sec)
Velocity constraint: $-120<(x_{25}-x_{24})<120$ (ft/sec)
Velocity constraint: $-120<(x_{26}-x_{25})<120$ (ft/sec)
Velocity constraint: $-120<(x_{27}-x_{26})<120$ (ft/sec)
Velocity constraint: $-120<(x_{28}-x_{27})<120$ (ft/sec)
Velocity constraint: $-120<(x_{29}-x_{28})<120$ (ft/sec)
Velocity constraint: $-120<(x_{30}-x_{29})<120$ (ft/sec)

The equations constraining acceleration are defined by a higher order difference, the acceleration, which is the second derivative of position. The $2^{nd}$ order central difference In an analogous way one can obtain finite difference approximations to higher order derivatives and differential operators. For example, by using the above central difference formula for $f'(x+h/2)$ and $f'(x-h/2)$ and applying a central difference formula for the derivative of $f'$ at x, we obtain the central difference approximation of the second derivative of $f$:

2nd Order Central $$f''(x) \approx \frac{\delta_h^2[f](x)}{h^2} = \frac{f(x+h)-2f(x)+f(x-h)}{h^2}.$$

The equation above may be used to write a set of 28 equations constraining acceleration:

Acceleration constraint: $-5<(x_3-2x_2+x_1)<5$ (ft/sec2)
Acceleration constraint: $-5<(x_4-2x_3+x_2)<5$ (ft/sec2)
Acceleration constraint: $-5<(x_5-2x_4+x_3)<5$ (ft/sec2)
Acceleration constraint: $-5<(x_6-2x_5+x_4)<5$ (ft/sec2)
Acceleration constraint: $-5<(x_7-2x_6+x_5)<5$ (ft/sec2)
Acceleration constraint: $-5<(x_8-2x_7+x_6)<5$ (ft/sec2)
Acceleration constraint: $-5<(x_9-2x_8+x_7)<5$ (ft/sec2)
Acceleration constraint: $-5<(x_{10}-2x_9+x_8)<5$ (ft/sec2)
Acceleration constraint: $-5<(x_{11}-2x_{10}+x_9)<5$ (ft/sec2)
Acceleration constraint: $-5<(x_{12}-2x_{11}+x_{10})<5$ (ft/sec2)
Acceleration constraint: $-5<(x_{13}-2x_{12}+x_{11})<5$ (ft/sec2)
Acceleration constraint: $-5<(x_{14}-2x_{13}+x_{12})<5$ (ft/sec2)
Acceleration constraint: $-5<(x_{15}-2x_{14}+x_{13})<5$ (ft/sec2)
Acceleration constraint: $-5<(x_{16}-2x_{15}+x_{14})<5$ (ft/sec2)
Acceleration constraint: $-5<(x_{17}-2x_{16}+x_{15})<5$ (ft/sec2)
Acceleration constraint: $-5<(x_{18}-2x_{17}+x_{16})<5$ (ft/sec2)
Acceleration constraint: $-5<(x_{19}-2x_{18}+x_{17})<5$ (ft/sec2)
Acceleration constraint: $-5<(x_{20}-2x_{19}+x_{18})<5$ (ft/sec2)
Acceleration constraint: $-5<(x_{21}-2x_{20}+x_{19})<5$ (ft/sec2)
Acceleration constraint: $-5<(x_{22}-2x_{21}+x_{20})<5$ (ft/sec2)
Acceleration constraint: $-5<(x_{23}-2x_{22}+x_{21})<5$ (ft/sec2)
Acceleration constraint: $-5<(x_{24}-2x_{23}+x_{22})<5$ (ft/sec2)

Acceleration constraint: $-5<(x_{25}-2x_{24}+x_{23})<5$ (ft/sec2)
Acceleration constraint: $-5<(x_{26}-2x_{25}+x_{24})<5$ (ft/sec2)
Acceleration constraint: $-5<(x_{27}-2x_{26}+x_{25})<5$ (ft/sec2)
Acceleration constraint: $-5<(x_{28}-2x_{27}+x_{26})<5$ (ft/sec2)
Acceleration constraint: $-5<(x_{29}-2x_{28}+x_{27})<5$ (ft/sec2)
Acceleration constraint: $-5<(x_{30}-2x_{29}+x_{28})<5$ (ft/sec2)

The set of above equations (87 equations in all) is solved by the loss of shunt fit code to find a violation of any constraint. When a constraint is violated, this is called a "strict loss of shunt fit failure."

The math library used to check for constraint satisfaction may be a highly optimized linear programming library called GLPK, a "Linear Programming Toolkit." This library is intended for solving large-scale linear programming (LP), mixed integer programming (MIP), and other related problems. It is a set of routines written in ANSI C and organized in the form of a callable library.

While various embodiments of the present invention have been described above, it should be understood that they have been presented by way of example only, and not limitation.

It will be understood that the above description of the present invention is susceptible to various modifications, changes and adaptations, and the same are intended to be comprehended within the meaning and range of equivalents of the appended claims.

What is claimed is:

1. A train circuit monitoring method comprising:

receiving track circuit data by a computer, wherein the track circuit data includes an indication of at least one shunted track circuit on at least one train track;

analyzing the received track circuit data and the at least one shunted track circuit by the computer;

tracking at least one train on the at least one train track based on the received track circuit data by the computer;

detecting a loss in physically expected track circuit occupancy in a path of at least one train by the computer;

generating a graph of the at least one shunted track circuit over time by the computer, wherein the graph indicates at least one of: losses in physically expected track circuit occupancy in the path of the at least one train, velocity of the at least one train, acceleration of the at least one train, or size of the at least one train;

executing a scoring algorithm to analyze an area of interest around a location of a detected event, wherein the scoring algorithm is based on a track occupancy history;

identifying one or more occupancy gaps in the at least one shunted track circuit in the area of interest, wherein the one or more occupancy gaps are filled in and the at least one train is fit into the one or more occupancy gaps;

if no occupancy gaps are detected in the area of interest, then the scoring algorithm fits the at least one train extending outside the at least one shunted track circuit;

measuring a distance that the at least one train was not detected by a vacant track circuit; and obtaining a severity value by multiplying the distance that the at least one train was not detected by the vacant track circuit by a number of seconds that a vacancy occurred;

generating an alert by the computer, wherein the alert comprises a severity and a track circuit identifier; and transmitting the alert by the computer.

2. The method of claim 1, further comprising:

detecting at least one of: a broken wire, bobbing, parasitic oscillation, corrugated rail, impedance bond, broken J-bar, broken rail clamp, broken rail connector, failed automatic train protection (ATP) module transmit printed circuit board (PCB), non-vital processor failure, rusty rail surface, contaminated rail surface, defective cable, remote terminal unit defective input PCB, arcing, spurious signals capable of exploiting unintended signal paths, interference, communication problems, insulating axle, or network problems.

3. The method of claim 1, further comprising:

calculating an enhanced train length, wherein the enhanced train length includes a physical length of a selected train of the at least one train and one or more train length adjustments;

identifying boundaries of the at least one shunted track circuit;

fitting the selected train within the boundaries of the at least one shunted track circuit; and attempting to locate the selected train on the at least one train track within the boundaries of the at least one shunted track circuit.

4. The method of claim 3, wherein if the selected train cannot be located on the train track within the boundaries of the at least one shunted track circuit:

identifying a vacant track circuit inside the enhanced train length; and transmitting an indication of the vacant track circuit.

5. The method of claim 3, wherein the one or more train length adjustments include at least one of an overhang adjustment, a remote terminal unit adjustment, one or more errors in track circuit length, or an empirical adjustment for change in domain between remote terminal units.

6. The method of claim 3, further comprising:

discounting one or more shunted track circuit indications when not physically possible by the selected train.

7. The method of claim 4, further comprising:

detecting an event if one of the following occurs in a period of time:

the selected train is located on the vacant track circuit, the selected train exceeds a maximum velocity, or the selected train exceeds a maximum acceleration.

8. The method of claim 7, wherein the maximum velocity of the selected train is 120 feet per second, the maximum acceleration of the selected train is 5 feet per second squared, or the period of time is 30 seconds.

9. The method of claim 1, wherein the track occupancy history corresponds to a location of the at least one train 12 seconds before detecting the event, a second location of the at least one train 12 seconds after detecting the event, plus a radius of 1440 feet around the location of the detected event.

10. The method of claim 1, further comprising:

transmitting the severity value; or indicating the severity value in the graph.

11. The method of claim 1, wherein the alert is generated when one or more of the following occur:

five consecutive train events in a same area of interest indicating severity values of at least 300 ft*seconds, wherein the same area of interest includes at least two track circuits;

three consecutive train events in the same area of interest indicating severity values of at least 800 ft*seconds; or two consecutive train events in the area of interest indicating the severity value of at least 1500 ft*seconds.

12. The method of claim 1, further comprising:

detecting a bobbing circuit when the at least one shunted track circuit indication data indicates circuit occupancy on the train track without a train.

13. The method of claim 1, further comprising:

detecting an event when the shunted track circuit indication data indicates the at least one train is performing something not physically possible or is violating operating rules.

14. The method of claim 4, further comprising:

using a graphic to identify a malfunctioning track circuit as the identified vacant track circuit.

15. The method of claim 3, further comprising:

indicating the selected train on the graph based on the located train on the at least one train track within the boundary of the at least one shunted track circuit.

16. A train monitoring system comprising:

a plurality of train tracks;

a plurality of track circuits including the plurality of train tracks, the plurality of circuits providing track circuit data;

an output device; and a processor connected to the output device, wherein the processor is capable of performing the following:

receiving the track circuit data, wherein the track circuit data comprises at least one indication of a shunted track circuit;

analyzing the received track circuit data and the at least one shunted track circuit;

tracking at least one train on one or more of the plurality of train tracks based on the received track circuit data;

detecting a loss in physically expected track circuit occupancy in a path of the at least one train;

generating a graph on the output device of the at least one shunted track circuit over time, wherein the graph indicates at least one of: losses in physically expected track circuit occupancy in the path of the at least one train, velocity of the at least one train, acceleration of the at least one train, or size of the at least one train;

executing a scoring algorithm to analyze an area of interest around a location of a detected event, wherein the scoring algorithm is based on a track occupancy history;

identifying one or more occupancy gaps in the at least one shunted track circuit in the area of interest, wherein the one or more occupancy gaps are filled in and the at least one train is fit into the one or more occupancy gaps;

if no occupancy gaps are detected in the area of interest, then the scoring algorithm fits the at least one train extending outside the at least one shunted track circuit;

measuring a distance that the at least one train was not detected by a vacant track circuit; and obtaining a severity value by multiplying the distance that the at least one train was not detected by the vacant track circuit by a number of seconds that a vacancy occurred; and generating an alert based on a severity value.

17. A non-transitory computer readable medium comprising instructions, which when executed by a processor causes the processor to perform operations for train monitoring comprising:

receiving track circuit data, wherein the track circuit data includes an indication of at least one shunted track circuit on at least one train track;

analyzing the received track circuit data and the at least one shunted track circuit;

tracking at least one train on the at least one train track based on the received track circuit data;

detecting a loss in physically expected track circuit occupancy in a path of the at least one train;

generating a graph of the at least one shunted track circuit over time, wherein the graph indicates at least one of: losses in physically expected track circuit occupancy in the path of the at least one train, velocity of the at least one train, acceleration of the at least one train, or size of the at least one train;

executing a scoring algorithm to analyze an area of interest around a location of a detected event, wherein the scoring algorithm is based on a track occupancy history;

identifying one or more occupancy gaps in the at least one shunted track circuit in the area of interest, wherein the one or more occupancy gaps are filled in and the at least one train is fit into the one or more occupancy gaps;

if no occupancy gaps are detected in the area of interest, then the scoring algorithm fits the at least one train extending outside the at least one shunted track circuit;

measuring a distance that the at least one train was not detected by a vacant track circuit; and obtaining a severity value by multiplying the distance that the at least one train was not detected by the vacant track circuit by a number of seconds that a vacancy occurred; and generating an alert, wherein the alert comprises a severity and a track circuit identifier.

18. The method of claim 1, further comprising:

generating an alarm instruction to stop one or more trains, the alarm comprising the track circuit identifier and one or more train identifiers.

19. A train circuit monitoring method comprising:

receiving track circuit data by a computer, wherein the track circuit data includes an indication of at least one shunted track circuit on at least one train track of a plurality of train tracks;

analyzing the received track circuit data and the at least one shunted track circuit by the computer;

tracking a plurality of trains on the plurality of train tracks based on the received track circuit data by the computer;

identifying, by the computer, boundaries of the at least one shunted track circuit;

fitting, by the computer, a selected train of the plurality of trains within the boundaries of the at least one shunted track circuit;

attempting, by the computer, to locate the selected train on a train track of the plurality of train tracks within the boundaries of the at least one shunted track circuit;

detecting a loss in physically expected track circuit occupancy in a path of the selected train by the computer;

executing a scoring algorithm to analyze an area of interest around a location of a detected event, wherein the scoring algorithm is based on a track occupancy history;

identifying one or more occupancy gaps in the at least one shunted track circuit in the area of interest, wherein the one or more occupancy gaps are filled in and the selected train is fit into the one or more occupancy gaps;

if no occupancy gaps are detected in the area of interest, then the scoring algorithm fits the selected train extending outside the at least one shunted track circuit;

measuring a distance that the selected train was not detected by a vacant track circuit;

obtaining a severity value by multiplying the distance that the selected train was not detected by the vacant track circuit by a number of seconds that a vacancy occurred;

generating a graph of the at least one shunted track circuit over time by the computer, wherein the graph indicates at least one of: losses in physically expected track circuit occupancy in the path of the selected train, velocity of the selected train, acceleration of the selected train, or size of the selected train;

generating an alert by the computer, wherein the alert comprises a severity and a track circuit identifier; and transmitting the alert by the computer.

20. The method of claim 19, further comprising:

detecting at least one of: a broken wire, bobbing, parasitic oscillation, corrugated rail, impedance bond, broken J-bar, broken rail clamp, broken rail connector, failed automatic train protection (ATP) module transmit printed circuit board (PCB), non-vital processor failure, rusty rail surface, contaminated rail surface, defective cable, remote terminal unit defective input PCB, arcing, spurious signals capable of exploiting unintended signal paths, interference, communication problems, insulating axle, or network problems.

21. The method of claim 19, further comprising:

discounting one or more shunted track circuit indications when not physically possible by the selected train.

22. The method of claim 19, further comprising:

calculating an enhanced train length, wherein the enhanced train length includes a physical length of the selected train and one or more train length adjustments.

23. The method of claim 22, wherein the one or more train length adjustments include at least one of an overhang adjustment, a remote terminal unit adjustment, errors in track circuit length, or an empirical adjustment for change in domain between remote terminal units.

24. The method of claim 19, wherein if the selected train cannot be located on the train track within the boundaries of the at least one shunted track circuit:

identifying a vacant track circuit inside the enhanced train length; and transmitting an indication of the vacant track circuit.

25. The method of claim 24, further comprising:

detecting an event if one of the following occurs in a period of time:

the selected train is located on the vacant track circuit, the selected train exceeds a maximum velocity, or the selected train exceeds a maximum acceleration.

26. The method of claim 25, wherein the maximum velocity of the selected train is 120 feet per second, the maximum acceleration of the selected train is 5 feet per second squared, or the period of time is 30 seconds.

27. The method of claim 1, wherein the track occupancy history corresponds to a location of the selected train 12 seconds before detecting the event, a second location of the selected train 12 seconds after detecting the event, plus a radius of 1440 feet around the ion of the detected event.

28. The method of claim 1, further comprising:

transmitting the severity value; or indicating the severity value in the graph.

29. The method of claim 1, wherein the alert is generated when one or more of the following occur:

five consecutive train events in a same area of interest indicating severity values of at least 300 ft*seconds, wherein the same area of interest includes at least two track circuits;

three consecutive train events in the same area of interest indicating severity values of at least 800 ft*seconds; or two consecutive train events in the area of interest indicating the severity value of at least 1500 ft*seconds.

30. The method of claim 19, further comprising:

detecting a bobbing circuit when the at least one shunted track circuit indication data indicates circuit occupancy on the train track without a train.

31. The method of claim 24, further comprising:

detecting an event when the shunted track circuit indication data indicates one or more trains of the plurality of trains are performing something not physically possible or are violating operating rules.

32. The method of claim 24, further comprising:

using a graphic to identify a malfunctioning track circuit as the identified vacant track circuit.

33. The method of claim 19, further comprising:

indicating the selected train on the graph based on a location of the selected train on the train track within the boundary of the at least one shunted track circuit.

34. The method of claim 19, wherein generating the graph of the at least one shunted track circuit over time by the computer further comprises:

plotting the at least one shunted track circuit based on time the shunted track circuit indication was received; and plotting a location of the selected train within the shunted track circuit based on time as at least one curve, wherein at least one of: a length of the at least one curve is based on a length of the selected train, a slope of the at least one curve is based on a velocity of the selected train, and a curvature of the at least one curve is based on an acceleration of the selected train.

35. The method of claim 19, further comprising:

generating an alarm instruction to stop one or more trains, the alarm comprising the track circuit identifier and one or more train identifiers.

36. A train monitoring system comprising:

a plurality of track circuits providing track circuit data on a plurality of train tracks;

an output device; and a processor connected to the output device, wherein the processor is capable of performing the following:

receiving the track circuit data, wherein the track circuit data comprises at least one indication of a shunted track circuit on at least one train track of the plurality of train tracks;

analyzing the received track circuit data and the at least one shunted track circuit;

tracking a plurality of trains on the plurality of train tracks based on the received track circuit data;

identifying boundaries of the at least one shunted track circuit;

fitting a selected train of the plurality of trains within the boundaries of the at least one shunted track circuit;

attempting to locate the selected train on a train track of the plurality of train tracks within the boundaries of the at least one shunted track circuit;

detecting a loss in physically expected track circuit occupancy in a path of the selected train;

executing a scoring algorithm to analyze an area of interest around a location of a detected event, wherein the scoring algorithm is based on a track occupancy history;

identifying one or more occupancy gaps in the at least one shunted track circuit in the area of interest, wherein the one or more occupancy gaps are filled in and the selected train is fit into the one or more occupancy gaps;

if no occupancy gaps are detected in the area of interest, then the scoring algorithm fits the selected train extending outside the at least one shunted track circuit;

measuring a distance that the selected train was not detected by a vacant track circuit;

obtaining a severity value by multiplying the distance that the selected train was not detected by the vacant track circuit by a number of seconds that a vacancy occurred;

generating a graph on the output device of the at least one shunted track circuit over time, wherein the graph indicates at least one of: losses in physically expected track circuit occupancy in the path of the selected train, velocity of the selected train, acceleration of the selected train, or size of the selected train; and generating an alert based on a severity value.

37. A non-transitory computer readable medium comprising instructions, which when executed by a processor causes the processor to perform operations for train monitoring comprising:

receiving track circuit data, wherein the track circuit data includes an indication of at least one shunted track circuit on at least one train track of a plurality of train tracks;

analyzing the received track circuit data and the at least one shunted track circuit;

tracking a plurality of trains on the plurality of train tracks based on the received track circuit data;

identifying boundaries of the at least one shunted track circuit;

fitting the selected train within the boundaries of the at least one shunted track circuit;

attempting to locate the selected train on the train track within the boundaries of the at least one shunted track circuit;

detecting a loss in physically expected track circuit occupancy in a path of the selected train;

executing a scoring algorithm to analyze an area of interest around a location of a detected event, wherein the scoring algorithm is based on a track occupancy history;

identifying one or more occupancy gaps in the at least one shunted track circuit in the area of interest, wherein the one or more occupancy gaps are filled in and the selected train is fit into the one or more occupancy gaps;

if no occupancy gaps are detected in the area of interest, then the scoring algorithm fits the selected train extending outside the at least one shunted track circuit;

measuring a distance that the selected train was not detected by a vacant track circuit;

obtaining a severity value by multiplying the distance that the selected train was not detected by the vacant track circuit by a number of seconds that a vacancy occurred;

generating a graph of the at least one shunted track circuit over time, wherein the graph indicates at least one of: losses in physically expected track circuit occupancy in the path of the selected train, velocity of the train, acceleration of the selected train, or size of the selected train; and generating an alert, wherein the alert comprises a severity and a track circuit identifier.

38. The method of claim 1, wherein generating the graph further comprises:

plotting the at least one shunted track circuit based on time the shunted track circuit indication was received; and plotting a location of the at least one train within the shunted track circuit based on time as at least one curve, wherein at least one of: a length of the at least one curve is based on a length of the at least one train, a slope of the at least one curve is based on a velocity of the at least one train, and a curvature of the at least one curve is based on an acceleration of the at least one train.

39. The method of claim 1, wherein the graph further comprises:

one or more color-coded dots indicating a time and a location of the one or more occupancy gaps, wherein a dot color of the one or more color-coded dots is based on the severity value, wherein a green dot indicates the severity value is less than 100 ft*sec, an orange dot indicates the severity value is between 100 and 800 ft*sec, and a red dot indicates the severity value is greater than 800 ft*sec.

* * * * *

UNITED STATES PATENT AND TRADEMARK OFFICE

CERTIFICATE OF CORRECTION

PATENT NO. : 8,996,208 B2
APPLICATION NO. : 13/544402
DATED : March 31, 2015
INVENTOR(S) : Shoppa et al.

It is certified that error appears in the above-identified patent and that said Letters Patent is hereby corrected as shown below:

In the Claims:

In claim 31, at column 27, in line 63, "The method of claim 24" should be --The method of claim 19--.

Signed and Sealed this
Fifth Day of January, 2016

Michelle K. Lee

Michelle K. Lee
*Director of the United States Patent and Trademark Office*